US007966999B2

(12) United States Patent
Bosch et al.

(10) Patent No.: US 7,966,999 B2
(45) Date of Patent: Jun. 28, 2011

(54) PAINTBALL LOADER SYSTEMS

(75) Inventors: John P. Bosch, Scottsdale, AZ (US); Clyde McKay, Scottsdale, AZ (US)

(73) Assignee: John P. Bosch, Scottsdale, AZ (US)

( * ) Notice: Subject to any disclaimer, the term of this patent is extended or adjusted under 35 U.S.C. 154(b) by 582 days.

(21) Appl. No.: 12/058,619

(22) Filed: Mar. 28, 2008

(65) Prior Publication Data

US 2008/0236558 A1 Oct. 2, 2008

Related U.S. Application Data

(60) Provisional application No. 60/909,373, filed on Mar. 30, 2007, provisional application No. 60/989,720, filed on Nov. 21, 2007.

(51) Int. Cl.
*F41B 11/02* (2006.01)

(52) U.S. Cl. ..... 124/51.1

(58) Field of Classification Search ..... 124/51.1
See application file for complete search history.

(56) References Cited

U.S. PATENT DOCUMENTS

| | | | |
|---|---|---|---|
| 1,922,023 | A | 7/1932 | Baer |
| 2,541,742 | A | 7/1951 | Booth |
| 4,025,071 | A | 5/1977 | Hodges |
| 4,352,348 | A | 10/1982 | Griffith |
| 5,954,042 | A | 9/1999 | Harvey |
| 6,213,110 | B1 | 4/2001 | Christopher et al. |
| 6,269,509 | B1 | 8/2001 | Mays |
| 6,415,781 | B1 | 7/2002 | Perrone |
| 6,502,567 | B1 | 1/2003 | Christopher et al. |
| 6,701,907 | B2 | 3/2004 | Christopher et al. |
| 6,792,933 | B2 | 9/2004 | Christopher et al. |
| 6,889,680 | B2 | 5/2005 | Christopher et al. |
| 6,978,776 | B2 | 12/2005 | Hamilton |
| 2006/0157041 | A1 | 7/2006 | Friesen |
| 2007/0012304 | A1 | 1/2007 | Van Dorsser et al. |

*Primary Examiner* — John Ricci

(74) *Attorney, Agent, or Firm* — Stoneman Law Patent Group; Martin L. Stoneman

(57) ABSTRACT

A paintball loader system designed to efficiently deliver paintballs to a paintball gun. The drive mechanism is a screw-type design comprising a resilient auger. A microcontroller is programmed to automatically adjust the rotation of the auger based on data from multiple sensor points within the loader. The auger is mounted such that both rotational axial movements are enabled during operation. The axial movement of the auger is used to maintain a constant force on the paintballs awaiting loading within the paintball gun.

40 Claims, 23 Drawing Sheets

| | FIRST DETECTION UNIT 364 | SECOND DETECTION UNIT 366 | AUGER SENSOR 432 | STATUS | ACTION BY SUBSYSTEM 460 | DISPLAY INDICATOR STATUS |
|---|---|---|---|---|---|---|
| 501 | D | N | 2ND POS | BALL JAMMED | REVERSE ONCE THEN FORWARD | GREEN AND RED FLASH |
| 502 | D | N | R | NO BALL | ALT. SLOW AND MED. SPEED | GREEN FLASH |
| 503 | D | D | R | NORMAL RUN | FULL SPEED | GREEN ON |
| 504 | N | N | 2ND POS | STACK FULL | STOP AND PULSE OCCASIONALLY | GREEN ON |
| 505 | N | N | R | NO BALL | ALT. SLOW AND MED. SPEED | GREEN FLASH |

2ND POS --- AUGER IS IN SECOND POSITION AND NO ROTATION DETECTED
D --- FLOW DETECTED
N --- NO FLOW DETECTED
R --- ROTATION DETECTED

FIG. 31

PAINTBALL LOADER SYSTEMS

CROSS-REFERENCE TO RELATED APPLICATION

The present application is related to and claims priority from prior provisional application Ser. No. 60/909,373, filed Mar. 30, 2007, entitled "PAINTBALL LOADER SYSTEMS", and is related to and claims priority from prior provisional application Ser. No. 60/989,720, filed Nov. 21, 2007, entitled "PAINTBALL LOADER SYSTEMS", the contents of both of which are incorporated herein by this reference and are not admitted to be prior art with respect to the present invention by the mention in this cross-reference section.

BACKGROUND

This invention relates to paintball loader systems. More particularly, it relates to providing paintball loader systems to efficiently deliver paintballs to a paintball gun (also known as paintball markers).

The game of paintball involves participants utilizing paintball guns that discharge frangible paint-filled balls "fired" from the gun that burst upon impact to leave a mark at the point of impact. Paintball guns use a pneumatic system for firing the paintballs, typically using compressed air or other compressed gas. Electronically controlled guns are generally capable of very high rates of fire, so much so that the limiting factor in firing speed is typically the rate at which "paint" can be loaded into the gun. In professional competitions, the rate of fire can be as much as 15 balls per second. Often a player will experience missed shots or skipped shots due to a hopper not keeping up with the operation of the gun.

A significant problem with high-speed loading of paintballs is the controlled application of forces on the paintball. High loading velocities are generally associated with the application of high levels of force to the paintballs. The inherent fragility of the paintballs limits the maximum level of force that can be concentrated on the surface of the ball without breakage.

An additional problem related to high-speed loading of paintballs is the need for consistent feeding of paintballs into the gun, without interference or interruption. Occasionally, a paintball will break within the hopper hindering the operation. Typically, paint-related debris must be cleared from the hopper before the hopper can be returned to full service. The closed construction of conventional hoppers makes cleaning both difficult and time-consuming. A system to overcome the above-described problems would be of great benefit in advancing the paintball sports.

OBJECTS AND FEATURES OF THE INVENTION

A primary object and feature of the present invention is to provide a system to overcome the above-described problems.

It is a further object and feature of the present invention to provide such a system that provides high loading speeds while reducing paintball breakage during loading. It is another object and feature of the present invention to provide such a system that provides high loading forces while reducing point loads on surface of the paintballs.

It is another object and feature of the present invention to provide such a system that maintains a substantially constant loading on a paintball "stack" extending to the paintball gun. It is a further object and feature of the present invention to provide such a system that assists in removing debris from the paintball storage compartment of the loader. It is another object and feature of the present invention to provide such a system that can be disassembled for cleaning without the use of tools.

It is another object and feature of the present invention to provide such a system that utilizes a lightweight auger and that adjusts the rotation of the auger in response to the firing rate of the paintball gun. It is another object and feature of the present invention to provide such a system It utilizes a resilient auger to control force loads on the paintballs during loading. It is a further object and feature of the present invention to provide such a system that reduces transfer loads between paintballs by reducing the length of the paintball "stack". It is another object and feature of the present invention to provide such a system that relocates stored paintballs from poor loading positions to favorable loading positions.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a paintball loader system comprising: at least one paintball storage compartment to store paintballs; mounted within such at least one paintball storage compartment, at least one rotatable auger structured and arranged to convey paintballs from such at least one paintball storage compartment to at least one ball passage leading to at least one paintball gun; and at least one rotator structured and arranged to rotate such at least one rotatable auger; wherein such at least one rotatable auger comprises at least one axial translator structured and arranged to assist axial translation of such at least one rotatable auger along at least one axis of rotation between at least one first auger position and at least one second auger position; wherein such at least one axial translator comprises at least one positional biaser, comprising at least one biasing force, structured and arranged to positionally bias such at least one rotatable auger toward such at least one first position; and wherein such at least one biasing force is structured and arranged to urge at least one first paintball toward the at least one paintball gun.

Moreover, it provides such a paintball loader system further comprising: such at least one ball passage structured and arranged to pass paintballs between such at least one paintball storage compartment and the at least one paintball gun in substantially single-file alignment; wherein rotation of such at least one rotatable auger is structured and arranged to exert at least one second force on the at least one first paintball, comprising at least one up-stream paintball of the single file alignment, during such rotation; and wherein such at least one second force is structured and arranged to convey the at least one first paintball generally toward such at least one ball passage.

Additionally, it provides such a paintball loader system wherein: such at least one rotatable auger is structured and arranged to be urged toward such at least one second position in response to the development of at least one resistance force, acting between the at least one first paintball and such at least one rotatable auger; and wherein at least one substantially constant force, comprising at least one of such at least one biasing force and such at least one second force, is structured and arranged to substantially constantly urge the at least one first paintball, comprising at least one up-stream paintball of such substantially single-file alignment, toward the at least one paintball gun.

Also, it provides such a paintball loader system further comprising: at least one rotation controller structured and arranged to control the rotation of such at least one rotatable auger; operationally coupled with such at least one rotation controller, at least one positional sensor structured and arranged to sense the position such at least one rotatable auger; wherein such at least one rotational controller is structured and arranged to adjust the rotation of such at least one rotatable auger in response to at least one positional condition of such at least one rotatable auger substantially comprising the presence of such at least one rotatable auger in such at least one first position or such at least one second position.

In addition, it provides such a paintball loader system wherein such at least one adjustment to the rotation of such at least one rotatable auger comprises at least one stop of rotation. And, it provides such a paintball loader system wherein such at least one rotator comprises: at least one electric motor structured and arranged to provide at least one rotational force; at least one force-transfer assembly structured and arranged to transfer the at least one rotational force generated by such at least one electric motor to such at least one rotatable auger; at least one electric power source structured and arranged to provide electric power usable by such at least one electric motor; and at least one electrical coupler structured and arranged to couple such at least one electric power source to such at least one electric motor; wherein conduction of the electric power by such at least one electrical coupler is controlled by such at least one rotational controller.

Further, it provides such a paintball loader system wherein such at least one rotational controller comprises: at least one position detector structured and arranged to detect the presence of such at least one rotatable auger in such at least one second position; wherein such at least one rotational controller is further structured and arranged to alter the delivery of the electric power through such at least one electrical coupler when such at least one position detector detects the presence of such at least one rotatable auger in such at least one second position. Even further, it provides such a paintball loader system wherein such at least one force-transfer assembly comprises: at least one projecting transfer member structured and arranged to transfer at least one force; at least one support member structured and arranged to support such at least one projecting transfer member in at least one position substantially parallel with such at least one axis of rotation; wherein such at least one support member is operably coupled with such at least one electric motor; wherein such at least one support member and such at least one projecting transfer member are structured and arranged to rotate about the at least one axis of rotation during operation of at least one electric motor; wherein such at least one rotatable auger comprises at least one aperture structured and arranged to slidably engage such at least one projecting transfer member; and wherein, when such at least one rotatable auger is slidably engaged thereon, rotation of such projecting transfer member produces the rotation of such at least one rotatable auger. Moreover, it provides such a paintball loader system wherein such at least one positional biaser comprises at least one helical spring acting between such at least one support member and such at least one end flange.

Additionally, it provides such a paintball loader system wherein such at least one force-transfer assembly comprises: at least one end flange coupled to such at least one rotatable auger; co-axial with the at least one axis of rotation, at least one lash cage structured and arranged to movably receive such at least one end flange; at least one interlocker structured and arranged to interlock such at least one end flange with such at least one lash cage; wherein such at least one interlocker comprises at least one axial translator structured and arranged to allow axial translation of such at least one end flange relative to such at least one lash cage; and wherein such at least one interlocker further comprises at least one rotational coupler structured and arranged to rotatably couple such at least one lash cage with such at least one end flange.

Also, it provides such a paintball loader system wherein: such at least one end flange comprises at least one projecting tab; such at least one lash cage comprises at least one longitudinal slot structured and arranged to movably receive such at least one projecting tab; such at least one longitudinal slot comprises at least one longitudinal slot-length at least greater than at least one longitudinal tab-thickness of such at least one projecting tab; and such at least one longitudinal slot comprises at least one transverse slot-width substantially equal to at least one transverse tab-width of such at least one projecting tab.

In addition, it provides such a paintball loader system wherein such at least one paintball storage compartment further comprises: at least one first guide-wall structured and arranged to guide the paintballs toward at least one first side of such at least one rotatable auger; at least one second guide-wall structured and arranged to guide the paintballs toward at least one second side of such at least one rotatable auger; at least one catch tray structured and arranged to catch debris occurring within such at least one paintball storage compartment during use; at least one debris passage structured and arranged to pass such ball-associated debris from such at least one paintball storage compartment to such at least one catch tray, and restrict passage of the paintballs from such at least one paintball storage compartment to such at least one catch tray; wherein such at least one debris passage is located within at least one of such at least one first guide-wall and such at least one second guide-wall; and wherein such at least one catch tray is located gravitationally below such at least one rotatable auger.

And, it provides such a paintball loader system wherein such at least one rotatable auger substantially comprises at least one resilient material structured and arranged to resiliently engage the at least one first paintball. Further, it provides such a paintball loader system wherein such at least one ball passage comprises: at least one hollow cylindrical channel structured and arranged to channel the paintballs to the at least one paintball gun in such substantially single-file alignment; wherein such at least one hollow cylindrical channel comprises located proximally of such at least one paintball storage compartment, at least one paintball entry portion, and located downstream of such at least one paintball entry portion, at least one paintball exit portion, wherein such at least one paintball exit portion comprises at least one first flow detector structured and arranged to detect at least one first paintball flow condition within such at least one paintball exit portion, and wherein such at least one paintball entry portion comprises at least one second flow detector structured and arranged to detect a second paintball flow condition within such at least one ball entry portion; wherein such at least one first flow detector and such at least one second flow detector are structured and arranged to report such first paintball flow condition and such second paintball flow condition to such at least one rotational controller; and wherein such at least one rotational controller is structured and arranged adjust at least one rotation characteristic of such at least one rotatable auger in response to such at least one of such first paintball flow condition and second paintball flow condition.

Even further, it provides such a paintball loader system wherein such at least one rotational controller is structured and arranged adjust at least one rotation characteristic of such at least one rotatable auger in response to such at least one of such first paintball flow condition and such second paintball flow condition. Moreover, it provides such a paintball loader system wherein such at least one rotational controller is structured and arranged adjust at least one rotation characteristic of such at least one rotatable auger in response to such at least one of such first paintball flow condition, such second paintball flow condition, and such at least one positional condition of such at least one rotatable auger.

Additionally, it provides such a paintball loader system wherein: such at least one rotational controller comprises at least one current draw sensor structured and arranged to sense at least one level of current draw by the such at least one electric motor; and such at least one rotational controller is structured and arranged adjust at least one rotation characteristic of such at least one rotatable auger in response to such at least one of such first paintball flow condition, such second paintball flow condition, such at least one positional condition of such at least one rotatable auger, and such at least one level of current draw by the such at least one electric motor.

Also, it provides such a paintball loader system wherein such at least one rotation characteristic comprises an adjustment of a rate of rotation. In addition, it provides such a paintball loader system wherein such at least one rotation characteristic comprises an adjustment to a direction of rotation. And, it provides such a paintball loader system wherein: such at least one first flow detector and such at least one second flow detector each comprise at least one optical sensor; such at least one ball passage comprises at least one optically transparent portion structured and arranged to be substantially optically transparent to such at least one optical sensor; and such optically transparent portion substantially isolates such at least one optical sensor from paint debris occurring within such at least one ball passage.

In accordance with another preferred embodiment hereof, this invention provides a paintball loader system comprising: at least one paintball storage compartment to store paintballs; at least one ball passage structured and arranged to pass the paintballs between such at least one paintball storage compartment and at least one paintball gun; at least one rotating conveyor to convey the paintballs from such at least one paintball storage compartment to such at least one ball passage; at least one catch tray structured and arranged to catch ball-associated debris occurring within such at least one paintball storage compartment during use; and at least one debris passage structured and arranged to pass such ball-associated debris from such at least one paintball storage compartment to such at least one catch tray, and restrict passage of the paintballs from such at least one paintball storage compartment to such at least one catch tray; wherein operation of such at least one rotating conveyor moves the paintballs generally toward such at least one ball passage and assists movement of such ball-related debris to such at least one catch tray; and wherein a reduction of paintball-related debris adjacent the paintballs during delivery to the at least one paintball gun is achieved.

Further, it provides such a paintball loader system wherein such at least one rotating conveyor comprises: at least one mechanical power source structured and arranged to produce at least one rotational force; and at least one power coupler structured and arranged to couple the at least one rotational force to such at least one conveyor. Even further, it provides such a paintball loader system wherein such at least one conveyor comprises at least one rotatable auger.

Moreover, it provides such a paintball loader system wherein such at least one paintball storage compartment further comprises: at least one first guide-wall structured and arranged to guide the paintballs toward at least one first side of such at least one rotatable auger; and at least one second guide-wall structured and arranged to guide the paintballs toward at least one second side of such at least one rotatable auger; wherein such at least one debris passage is located within at least one of such at least one first guide-wall and such at least one second guide-wall.

Additionally, it provides such a paintball loader system wherein such at least one catch tray is located gravitationally below such at least one rotatable auger. Also, it provides such a paintball loader system further comprising: at least one removable tray assembly structured and arranged to be removable from at least one paintball storage compartment without the use of tools; wherein such at least one removable tray assembly at least comprises such at least one rotatable auger and such at least one catch tray.

In addition, it provides such a system wherein: such at least one rotatable auger is removable from such at least one removable tray assembly to assist cleaning of such at least one catch tray; and such at least one rotatable auger is removable from such at least one removable tray assembly without tools. And, it provides such a system wherein such at least one rotatable auger comprises helical flighting wound about such at least one longitudinal axis of rotation; wherein such helical flighting comprises at least one ball engager structured and arranged to engage at least one outer surface portion of at least one paintball; and wherein such at least one ball engager substantially comprises at least one resilient material structured and arranged to resiliently engage the at least one paintball during such conveyance.

In accordance with another preferred embodiment hereof, this invention provides a paintball loader system comprising: at least one paintball storage compartment to store paintballs; at least one ball passage structured and arranged to pass the paintballs between such at least one paintball storage compartment and at least one paintball gun; rotatably mounted within such at least one paintball storage compartment, at least one rotatable auger to convey the paintballs from such at least one paintball storage compartment to such at least one ball passage; and at least one rotator structured and arranged to rotate such at least one rotatable auger; wherein rotation of such at least one rotatable auger exerts at least one force on at least one paintball during such rotation; wherein such at least one force conveys the at least one paintball generally toward such at least one ball passage; wherein such at least one rotatable auger comprises at least one resilient material structured and arranged to resiliently engage the at least one paintball during such conveyance; wherein such at least one resilient material is further structured and arranged to assist in maintaining such at least one moving force within a limit settable by at least one selected resiliency.

Further, it provides such a paintball loader system further comprising: at least one rotation controller structured and arranged to control the rotation of such at least one rotatable auger; and operationally coupled with such at least one rotation controller, at least one load sensor structured and arranged to sense force loading on such at least one rotatable auger; wherein such at least one rotational controller is structured and arranged to adjust the rotation of such at least one rotatable auger in response to such force loading; and wherein such adjustment to the rotation assists in maintaining such at least one force within such limit.

In accordance with another preferred embodiment hereof, this invention provides a paintball loader system comprising: at least one paintball storage compartment to store paintballs; at least one ball passage structured and arranged to pass the paintballs between such at least one paintball storage compartment and at least one paintball gun; and at least one conveyor to convey the paintballs from such at least one paintball storage compartment to such at least one ball passage; wherein such at least one conveyor comprises at least one ball selector structured and arranged to select the paintballs favorably positioned for delivery to such at least one ball passage, and at least one ball ejector structured and arranged to eject paintballs unfavorably positioned for delivery to such at least one ball passage from such at least one conveyor; wherein such paintballs favorably positioned for delivery to such at least one ball passage are passed into such at least one ball passage by such at least one conveyor; wherein such paintballs unfavorably positioned for delivery to such at least one ball passage are ejected from such at least one conveyor; and wherein such at least one paintball storage compartment comprises at least one relocator structured and arranged to relocate the paintballs ejected from such at least one conveyor to at least one area of such at least one paintball storage compartment generally favorable to the delivery of such ejected paintballs to such at least one ball passage by such at least one conveyor.

Even further, it provides such a paintball loader system further comprising: at least one mechanical power source structured and arranged to produce mechanical power usable to operate such at least one conveyor; and at least one power coupler structured and arranged to couple the mechanical power to such at least one conveyor; wherein such at least one conveyor comprises at least one rotatable auger rotatably mounted within such at least one paintball storage compartment; wherein such at least one rotatable auger comprises at least one longitudinal axis of rotation, and helical flighting wound about such at least one longitudinal axis of rotation; wherein such helical flighting comprises at least one ball engager structured and arranged to engage at least one outer surface portion of at least one paintball; wherein such at least one power coupler is structured and arranged to transfer at least one rotational force generated by such at least one mechanical power source to such at least one rotatable auger; and wherein rotation of such at least one rotatable auger moves the paintballs engaged within such at least one ball engager generally toward such at least one ball passage. Even further, it provides such a paintball loader system wherein such at least one ball engager substantially comprises at least one resilient material.

Even further, it provides such a paintball loader system wherein such at least one paintball storage compartment comprises: at least one first guide-wall structured and arranged to guide the paintballs toward at least one first side of such at least one rotatable auger; and at least one second guide-wall structured and arranged to guide the paintballs toward at least one second side of such at least one rotatable auger; wherein such at least one relocator comprises, extending between such at least one first guide-wall and such at least one second guide-wall, at least one transverse guide wall structured and arranged to guide movement of the ejected paintballs between such at least one second side and such at least one first side; and wherein such at least one ball ejector comprises at least one contact interaction between the at least one paintball and such at least one transverse guide wall. Even further, it provides such a paintball loader system further comprising: at least one catch tray structured and arranged to catch and retain debris generated within such at least one paintball storage compartment during operation; and at least one debris passage structured and arranged to pass such debris from such at least one paintball storage compartment to such at least one catch tray, and restrict passage of the paintballs from such at least one paintball storage compartment to such at least one catch tray. Even further, it provides such a paintball loader system wherein such at least one debris passage is located within at least one of such at least one first guide-wall and such at least one second guide-wall; and such at least one catch tray is located gravitationally below such at least one rotatable auger.

Even further, it provides such a paintball loader system wherein: such at least one first guide-wall and such at least one second guide-wall together define at least one ball channel structured and arranged to channel the paintballs engaged within such at least one ball engager toward such at least one ball passage; such at least one ball channel is oriented substantially parallel with such at least one longitudinal axis of rotation; such at least one rotatable auger is located adjacent such at least one ball channel; and such at least one ball passage originates within such at least one transverse guide wall.

Moreover, it provides such a paintball loader system wherein: such at least one rotatable auger comprises at least one proximal auger end-region and at least one distal auger end-region; such at least one proximal auger end-region is positioned generally adjacent such at least one power coupler; such at least one distal auger end-region is positioned generally adjacent such at least one ball passage; and such at least one first guide-wall comprises at least one first guide ramp structured and arranged to guide the paintballs toward such at least one proximal auger end-region. Even further, it provides such a paintball loader system wherein: such at least one second guide-wall comprises at least one second guide ramp structured and arranged to guide the paintballs toward such at least one distal auger end-region; and such at least one second guide-wall comprises at least one ejection ramp structured and arranged to lift paintballs unfavorably positioned for delivery to such at least one ball passage from such at least one conveyor as such paintballs approach such at least one transverse guide wall.

Even further, it provides such a paintball loader system wherein: such at least one rotatable auger is free to move axially along such at least one longitudinal axis of rotation between at least one first position and at least one second position; such at least one power coupler comprises at least one rotation adjuster structured and arranged to adjust the rotation of such at least one rotatable auger by such at least one mechanical power source when such at least one rotatable auger is in such at least one second position; such at least one power coupler comprises at least one positional biaser structured and arranged to bias such at least one rotatable auger toward such at least one first position; such at least one rotatable auger is translated to such at least one second position by at least one pressure resistance exerted between the paintballs within such at least one ball channel. Even further, it provides such a paintball loader system further comprising: at least one removable tray assembly structured and arranged to be removable from such at least one paintball storage compartment; wherein such at least one removable tray assembly at least comprises such at least one rotatable auger, such at least one mechanical power source, and such at least one power coupler.

BRIEF DESCRIPTION OF THE DRAWINGS

FIG. 1 shows the paintball loader mounted to a paintball gun in a preferred operational position.

FIG. 31 is a table indicating preferred operation relationships between the reporting of sensors and control of ball delivery within the alternate paintball loader of FIG. 15.

DETAILED DESCRIPTION OF THE BEST MODES AND PREFERRED EMBODIMENTS OF THE INVENTION

Figure 2:
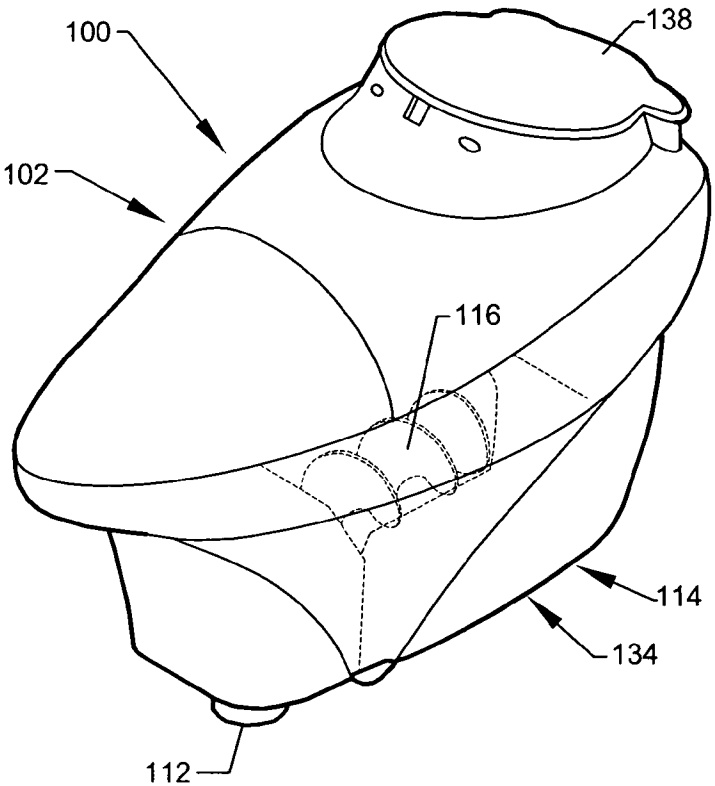
FIG. 2 shows an overall perspective view of the paintball loader according to the preferred embodiment of FIG. 1.
Figure 1:
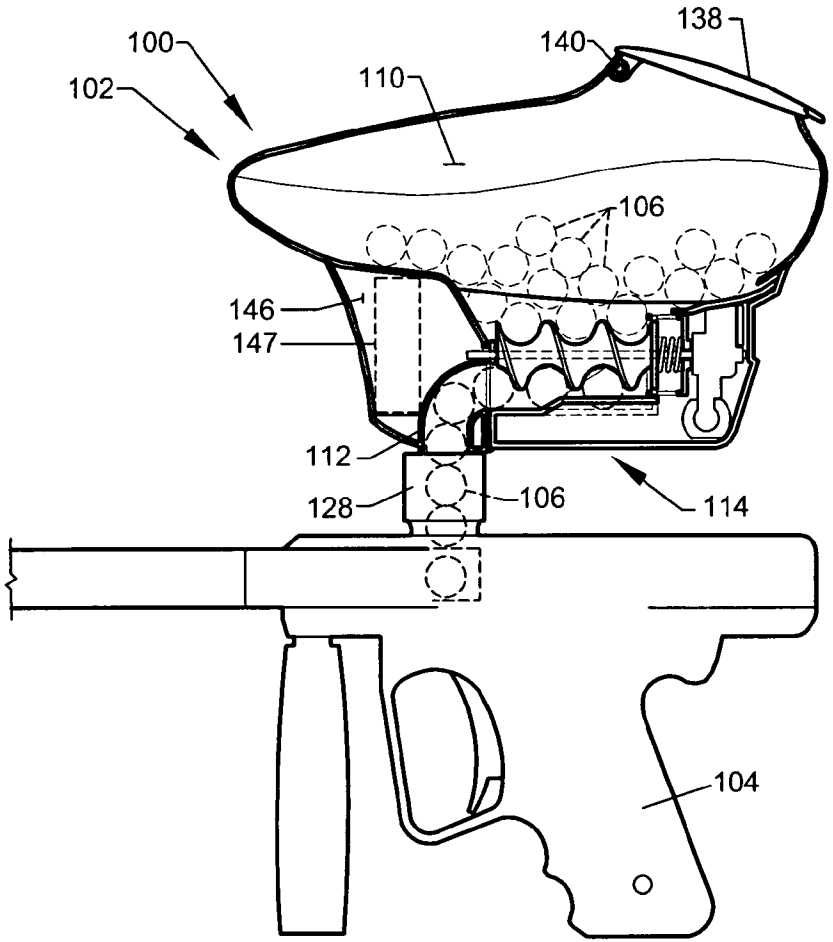
FIG. 1 shows a partial sectional view cut longitudinally through a paintball loader according to a preferred embodiment of the present invention.
Figure 3:
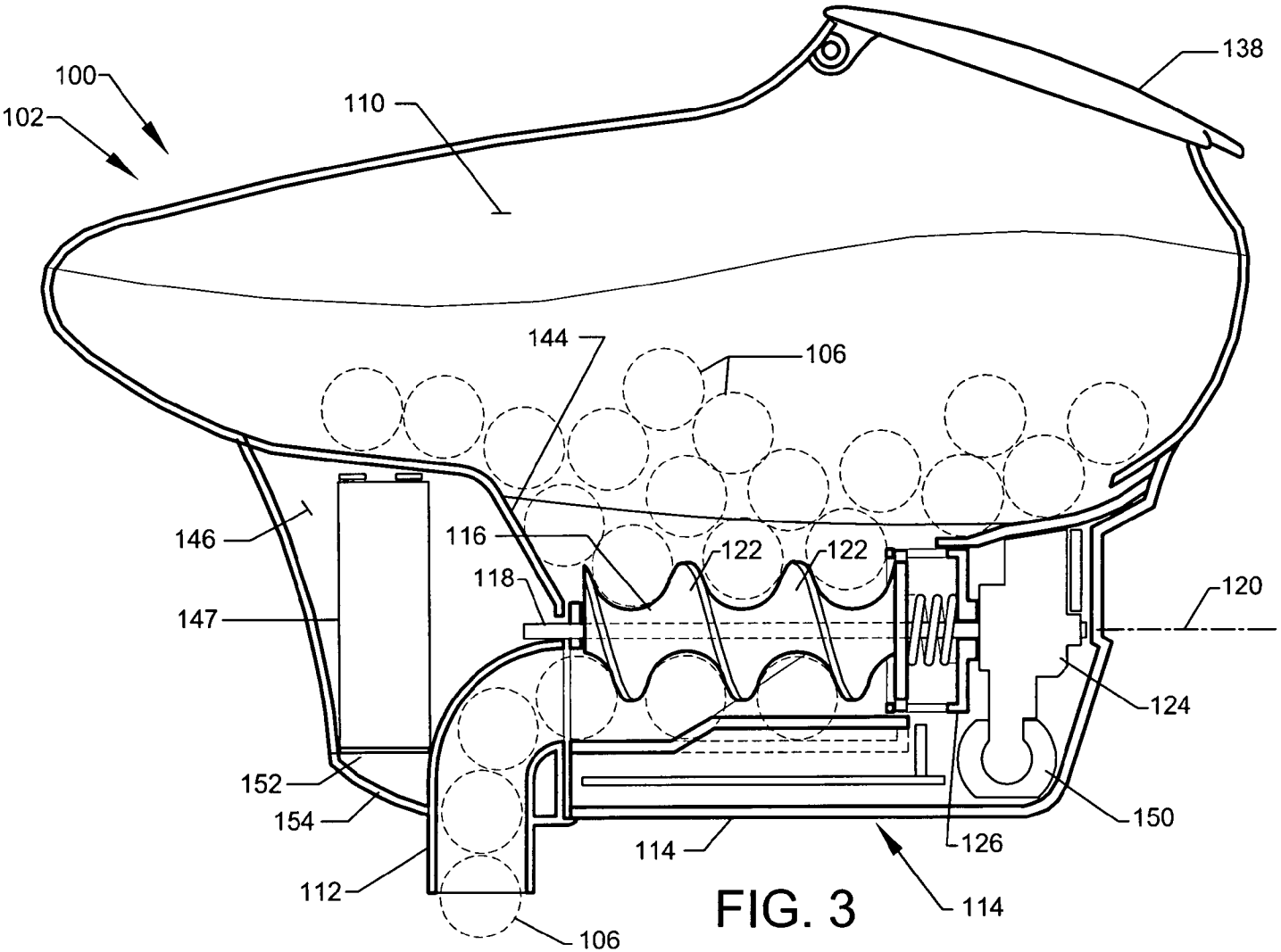
FIG. 3 a partial sectional view cut longitudinally through the paintball loader FIG. 1.

FIG. 1 shows a partial sectional view cut longitudinally through a high-speed paintball loader 102 according to a preferred embodiment of the present invention. FIG. 1 shows paintball loader 102 mounted to paintball gun 104 in a preferred operational position. FIG. 2 shows an overall perspective view of paintball loader 102 according to the preferred embodiment of FIG. 1. FIG. 3 a partial sectional view cut longitudinally through paintball loader 102 of FIG. 1.

Paintball loader 102 is illustrative of a preferred embodiment of loader system 100. Paintball loader 102 is preferably designed to hold a plurality of paintballs and to efficiently deliver the paintballs to the breach of a paintball gun at a high sustainable feed rate.

Preferably, paintball loader 102 of paintball loader system 100 comprises paintball storage compartment 110 functioning to store the plurality of paintballs 106 prior to transfer to the breach 108 of paintball gun 104, as shown. Preferably, feedneck 112 is coupled to the lower front portion of paintball storage compartment 110 and preferably functions to pass paintballs 106 between paintball storage compartment 110 and the inlet of breach 108, as shown. A "stack" of paintballs 106 are shown within feedneck 112 awaiting delivery to paintball gun 104. Feedneck 112 preferably comprises a hollow tubular channel having an interior diameter of slightly greater size than the outer diameter of paintballs 106, as shown. The larger diameter of feedneck 112 provides sufficient clearance for the passage of airflow around paintballs 106 while reducing the effects of blowback from the paintball gun 104. Feedneck 112 preferably comprises a directional transition between a generally horizontal inlet from paintball storage compartment 110 to a generally vertical outlet extension structured and arranged to firmly engage the female feedneck receiver 128 of paintball gun 104, as best shown in FIG. 1. Preferably, feedneck 112 is relatively short to minimize the number of paintballs within the "stack", as shown. Feedneck 112 is preferably adapted to contain fully not more than about three paintballs 106, as shown.

A specialized power-driven conveyor assembly 114 is preferably used to mechanically convey paintballs 106 from paintball storage compartment 110 to feedneck 112 (at least embodying herein at least one passage structured and arranged to pass the paintballs between such at least one paintball storage compartment and the at least one breach inlet), as shown. Preferably, conveyor assembly 114 occupies the lower portion of paintball storage compartment 110 to allow gravity-assisted movement of the plurality of paintballs 106 toward the conveyance mechanism, as shown.

Conveyor assembly 114 preferably comprises at least one rotating auger 116 positioned within the lower portion of paintball storage compartment 110, as shown. Preferably, auger 116 is rotatably mounted on auger shaft 118 that is preferably aligned coaxially along longitudinal axis of rotation 120, as shown. Preferably, auger 116 comprises helical flighting 122 spiral wound about longitudinal axis of rotation 120, as shown. Preferably, the concave interstitial spaces of helical flighting 122 are shaped to closely match the outer circumferential surfaces (that is, at least one outer surface portion) of paintballs 106, as shown. These concave interstitial spaces preferably comprise about a 0.75-inch radius and function to contact a relatively large portion of the outer surface of paintballs 106, as shown. This preferred arrangement allows auger 116 to engage the paintballs in a manner that allows for improved distributed transfer of conveyance forces. Since the total force applied to the surface of the ball is spread over a wide area, the level of concentrated point loading at the surface of the ball is decreased. This allows the application of greater overall levels of pressure force while decreasing the risk of ball breakage.

In addition, auger 116 acts as a force distributor, allowing the moving force to be distributed to individual paintballs 106 queued within the ball "stack", rather than applying a single point load on the initial ball of the "stack". Upon reading the teachings of this specification, those of ordinary skill in the art will now understand that, under appropriate circumstances, considering such issues as intended use, advances in technology, etc., other force transfer arrangements, such as, rotating wheels, belts, cups, etc., may suffice.

Preferably, auger 116 is operationally coupled to a mechanical power source identified herein as power assembly 124, as shown. Preferably, power assembly 124 is structured and arranged to produce mechanical power, most preferably a rotational torque usable to operate conveyor assembly 114. In most preferred embodiments, power assembly 124 utilizes an electrically driven motor 150 to produce such mechanical power. Upon reading the teachings of this specification, those of ordinary skill in the art will now understand that, under appropriate circumstances, considering such issues as user preference, intended use, etc., other torque generation arrangements, such as springs, pneumatic drives, etc., may suffice. Preferably, power coupler 126 is positioned between power assembly 124 and auger 116 and preferably functions to transfer the rotational force generated by power assembly 124 to auger 116, as shown. Preferably, rotation of auger 116 moves the paintballs 106 engaged within auger 116 in a direction generally toward transverse guide wall assembly 144 (the forward wall containing the opening to feedneck 112), as shown.

The preferred outer shape of paintball storage compartment 110 is generally aerodynamic in character, as shown, being more slender in the front, to increase the chance of safely deflecting incoming paintball away from the system.

Figure 4:
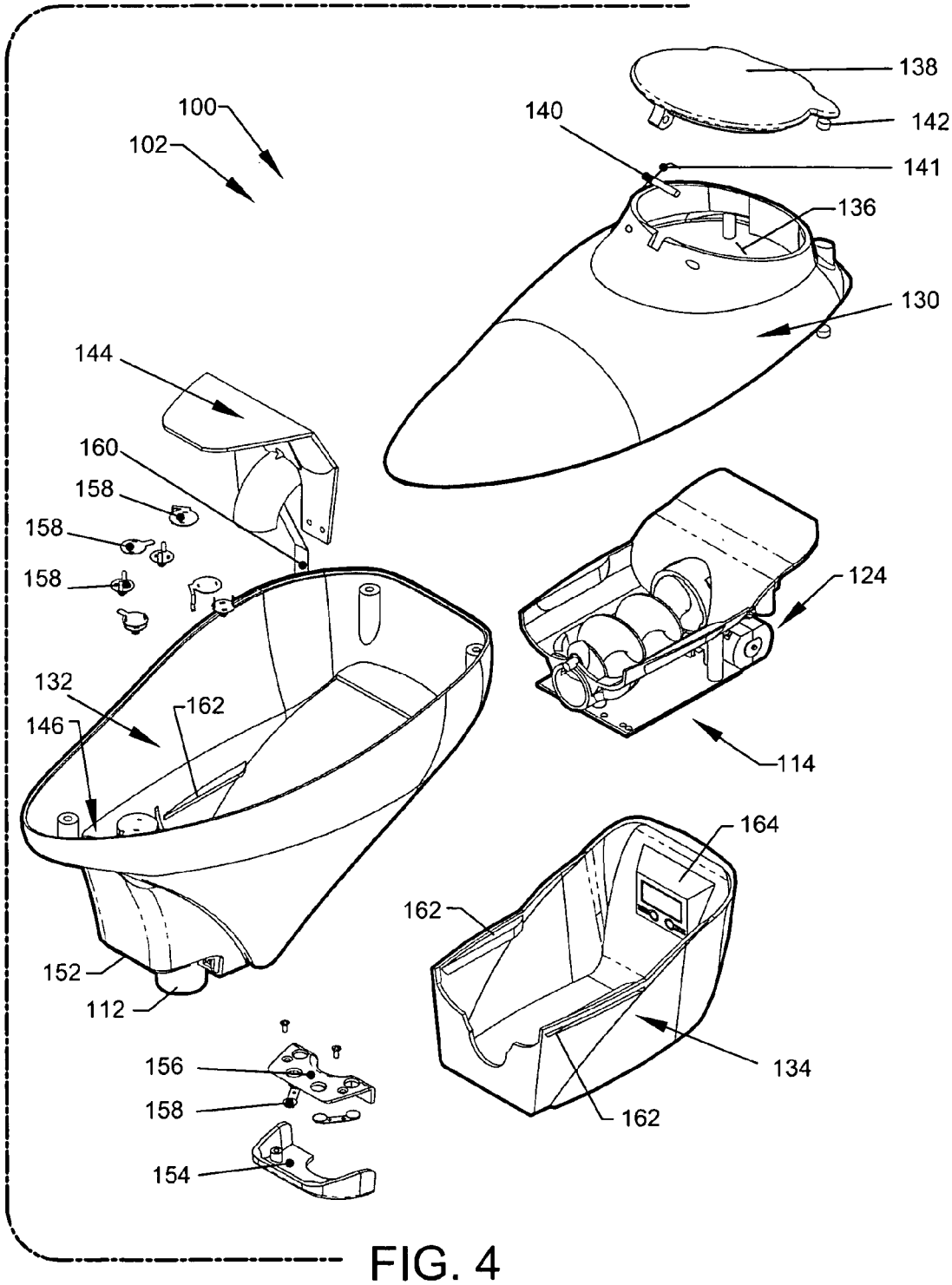
FIG. 4 shows an exploded view of the paintball loader according to the preferred embodiment of FIG. 1.

FIG. 4 shows an exploded view of paintball loader 102 according to the preferred embodiment of FIG. 1. Paintball loader 102 is preferably assembled from a number of individual subcomponents, as shown. The main supportive structure of paintball loader 102 is preferably assembled around three principal subcomponents, identified herein as upper housing portion 130, main housing portion 132, and removable back housing 134, as shown. Preferably, removable back housing 134 is adapted to contain conveyor assembly 114, as shown. Together, upper housing portion 130, main housing portion 132, and removable back housing 134 define paintball storage compartment 110.

Preferably, upper housing portion 130 comprises a generally circular access opening 136 used to refill paintball storage compartment 110, as shown. Preferably, a pivoting door cover 138 covers access opening 136 to prevent loss of paintballs during operation. Door pivot assembly 140 preferably comprises a pivot shaft and tension spring 141 used to bias door cover to an open position. Preferably, door cover 138 comprises door retainer assembly 142 designed to secure door cover 138 in a closed position. Preferably, door retainer assembly 142 comprises at least one magnet, mounted within door cover 138, interoperating with at least one magnetic element located within upper housing portion 130, as shown.

For efficiency of fabrication, transverse guide wall assembly 144 is preferably constructed as a separate insert that is permanently bonded to main housing portion 130 during assembly (see FIG. 3 for preferred positioning). For efficiency of fabrication, a portion of feedneck 112 is integrally formed with transverse guide wall assembly 144, as shown. When installed, the sloping upper horizontal extension of transverse guide wall assembly 144 forms the upper boundary of a battery-holding compartment, as shown. Preferably, battery compartment 146 is adapted to hold at least one electrical power source, most preferably one or more batteries 147 used to supply direct current to electrically driven motor 150 (see FIG. 3). Preferably, batteries 147 are of an expendable or rechargeable (secondary) type. Preferably, main housing portion 130 comprises a lower battery access opening 152 allowing access to the interior of battery compartment 146 for battery renewal. Preferably, a removable battery door 154 snap-fits over battery access opening 152 (as shown) to seal the compartment during use. Preferably, battery door 154 comprises battery doorplate 156 supporting conductive contacts 158 for the batteries, as shown. Similarly, a set of upper conductive contacts 158 are fitted to the underside of the sloping upper horizontal extension of transverse guide wall assembly 144, as shown. Preferably, at least one set of power contact links 160 conducts the electrical current supplied by the batteries to power assembly 124. Preferably, battery compartment 146 is located in the forward portion of paintball loader 102 to improve overall weight balance.

Preferably, removable back housing 134 is slidably engaged within a lower rear opening of main housing portion 132, as shown. This preferred tray-like feature allows (as shown) the entire conveyor assembly 114 to be removed from the main storage compartment for inspection and service (at least embodying herein at least one removable tray assembly structured and arranged to be removable from at least one paintball storage compartment). Preferably, removable back housing 134 and lower rear opening of main housing portion 132 each comprise a set of complementary interlocking alignment rails 162 (as shown) to assist in accurately positioning removable back housing 134 within main housing portion 132 during insertion. Preferably, removable back housing 134 comprises user interface accommodation 164, providing access to user interface board 166 (located within the rear of conveyor assembly 114), as shown.

Figures 5, 6:
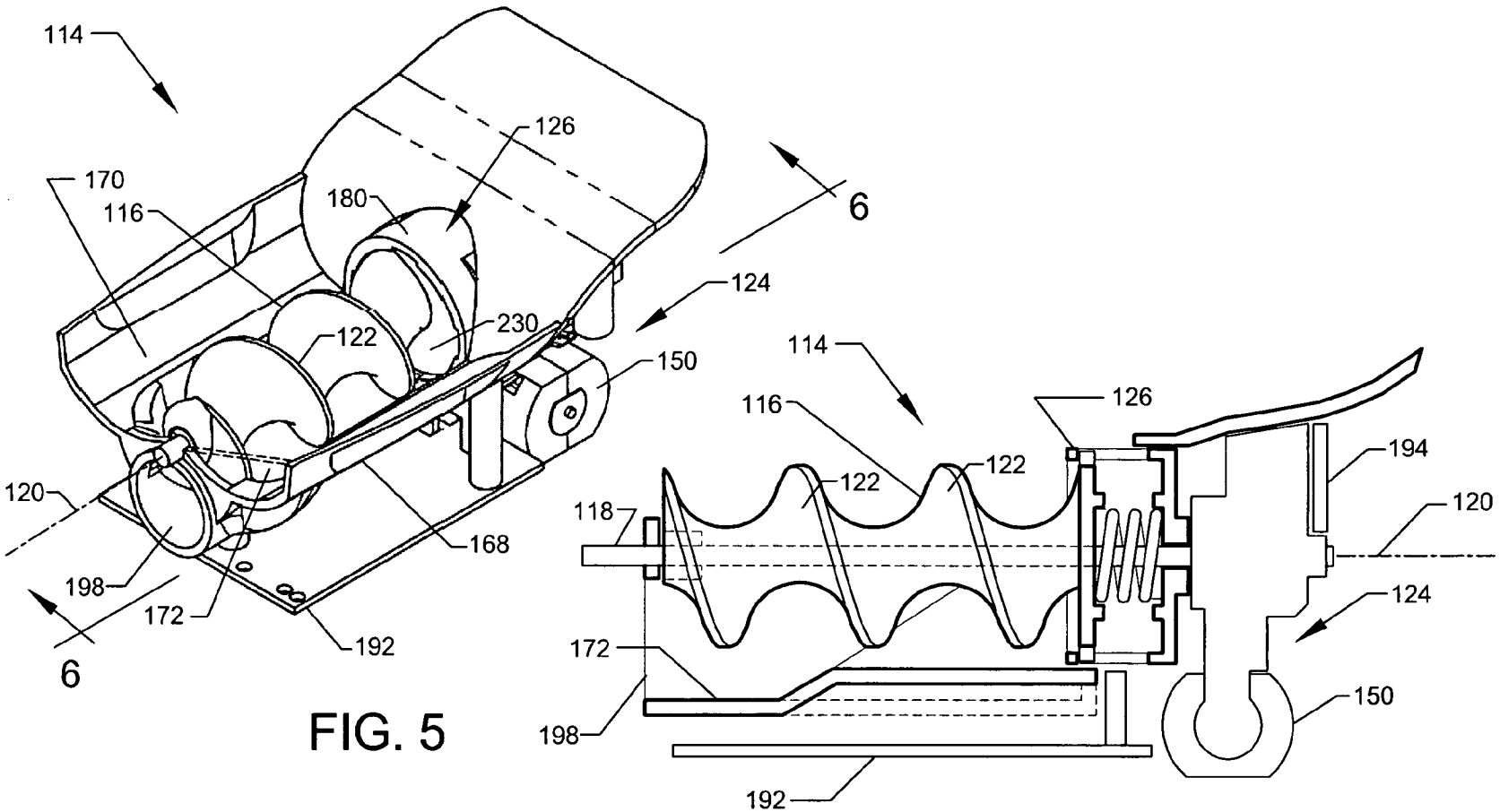
FIG. 5 shows a perspective view of a paintball conveyor assembly according to the preferred embodiment of FIG. 1.
FIG. 6 shows the sectional view 6-6 of FIG. 5 according to the preferred embodiment of FIG. 1.

FIG. 5 shows a perspective view of an assembled conveyor assembly 114, separated from removable back housing 134 for clarity. FIG. 6 shows the sectional view 6-6 of FIG. 5 illustrating the functional components of conveyor assembly 114. Preferably, auger 116 is positioned within an arrangement of guide walls that cooperatively control the loading of paintballs 106. Preferably, first guide-wall 168 and second guide-wall 170 flank opposing sides of auger 116 and together form a uniquely shaped ball channel 172 located generally below auger 116, as shown. Preferably, ball channel 172 is structured and arranged to channel paintballs 106 engaged within auger 116 engager along a non-linear path toward opening 198 of feedneck 112, as shown. The preferred physical configuration of ball channel 172 and its importance to the improved loading of paintballs 106 is further discussed in reference to FIG. 8

Figure 7:
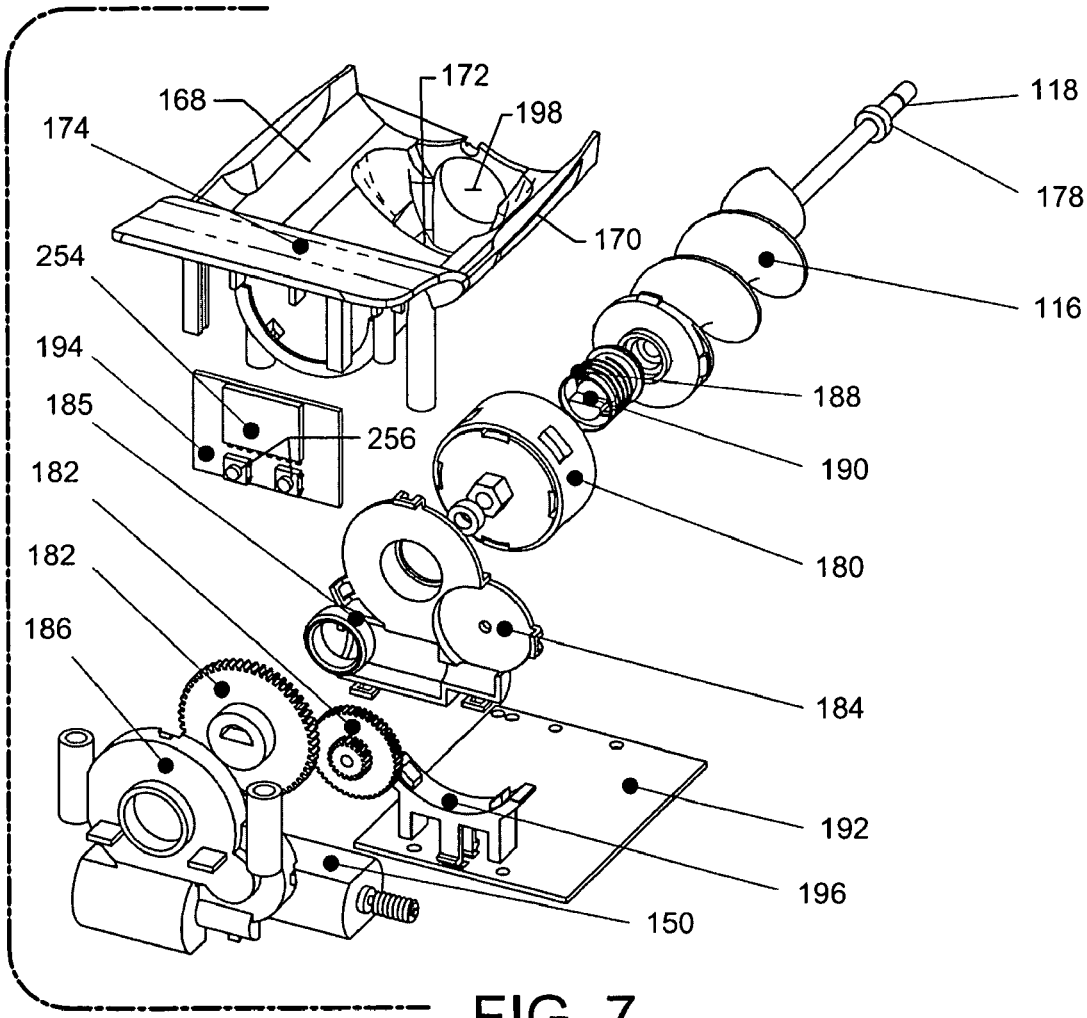
FIG. 7 shows an exploded view of the paintball conveyor assembly of FIG. 5.

FIG. 7 shows an exploded view of conveyor assembly 114 of FIG. 5. The preferred subcomponents of conveyor assembly 114 comprise (as shown) ball channel 172 with integral drive support portion 174, auger 116, auger shaft 118, end flange 176 (integrally joined with auger shaft 118), shaft bearing 178, cylindrical lash cage 180, reduction gears 182, forward gear cover 184, gear bearing 185, rear gear cover 186, bias spring 188, electrically driven motor 150, and gear engager 190 (coupling lash cage 180 to reduction gears 182). In addition, conveyor assembly 114 preferably comprises main electronics board 192 with sensor unit 196, and user interface electronics board 194, as shown. FIG. 7 generally illustrates preferred subcomponent locations and assembly orientations. Upon reading the teachings of this specification, those of ordinary skill in the art will now understand that, under appropriate circumstances, considering such issues as intended use, target markets, cost, advances in technology, etc., other component arrangements, such as alternate mounting points, alternate gearing and gear engagements, alternate sensor locations, longer auger assemblies, alternate electronic board locations, etc., may suffice.

Figure 8:
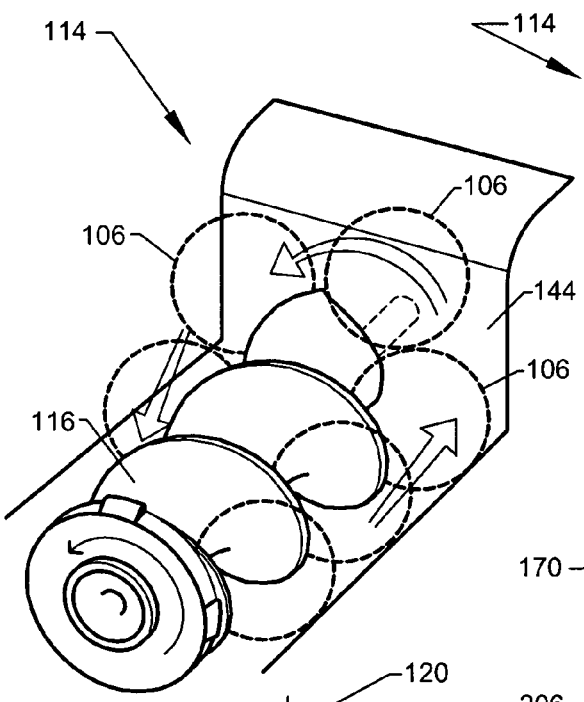
FIG. 8 shows a schematic perspective view, generally illustrating preferred paintball selection and loading processes, according to the preferred embodiment of FIG. 1.
Figure 9:
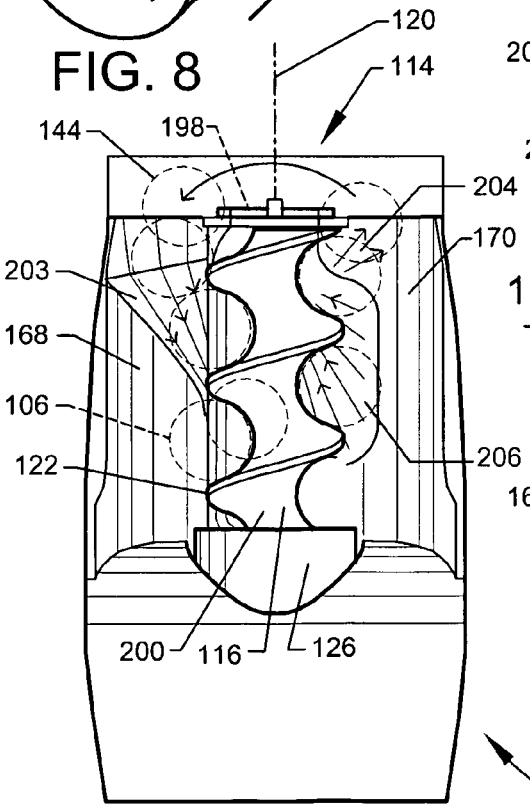
FIG. 9 shows a top view of the assembled paintball conveyor assembly of FIG. 5.
Figure 10:
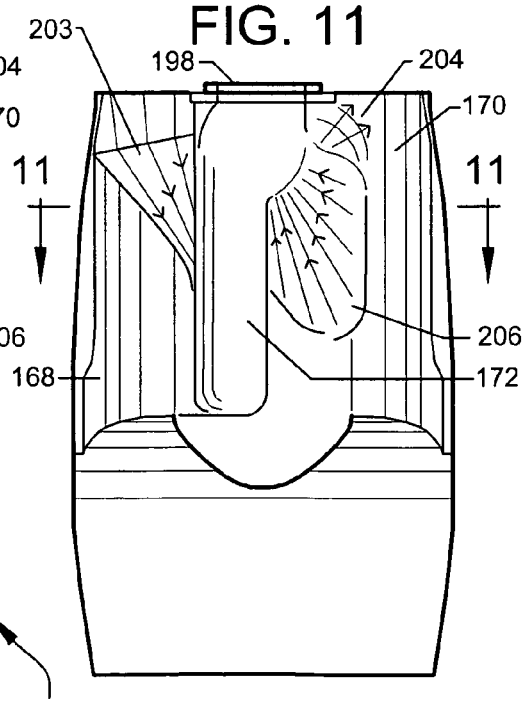
FIG. 10 shows a top view of the paintball conveyor assembly of FIG. 5 illustrating a preferred arrangement of guide walls.

FIG. 8 shows a schematic perspective view, generally illustrating preferred paintball selection and loading processes, according to the preferred embodiment of FIG. 1. FIG. 9 shows a top view of the conveyor assembly 114 of FIG. 5. FIG. 10 shows a top view of conveyor assembly 114, with auger 116 removed, to further illustrate a preferred arrangement of the guide walls 168 and 170. In the following description, specific reference will be made to FIG. 8, FIG. 9, and FIG. 10, with continued reference to the prior figures. In the following descriptions, rotation of auger 116 is assumed to be counterclockwise, unless noted otherwise. Arrow depictions within the ramp illustrations of FIG. 8, FIG. 9, and FIG. 10 indicate prevailing direction of paintball travel during loading operation.

A preferred feature of paintball loader system 100 is the ability of conveyor assembly 114 to selectively manipulate paintballs within paintball storage compartment 110 to provide improved loading consistency, regardless of the quantities of paintballs that are stored within the compartment.

Preferably, conveyor assembly 114 is designed to perform a first selection process wherein paintballs 106, favorably positioned for loading, are conveyed by auger 116 to opening 198 at feedneck 112. In a second preferred selection process, conveyor assembly 114 is preferably designed to eject paintballs 106 unfavorably positioned for delivery to feed neck 112 from conveyor assembly 114. Both FIG. 8 and FIG. 9 illustrate the mechanics of the selection process. In general, the selection is preferably enabled by the interoperation of auger 116 with first guide-wall 168 and second guide-wall 170.

As previously described, first guide-wall 168 and second guide-wall 170 together define ball channel 172, preferably located generally below auger 116, as best illustrated in FIG. 10. Preferably, ball channel 172 is adapted to channel paintballs 106, engaged within the helical flighting 122 of auger 116, on a substantially non-linear path toward opening 198 at feedneck 112. Preferably, the bottom of ball channel 172 comprises ball rail 209 adapted to guide paintballs 106 initially along a path oriented substantially parallel with longitudinal axis of rotation 120, as shown. Preferably, ball channel 172 flattens at distal channel area 208 allowing paintballs 106 to fall in alignment with opening 198, as shown.

Preferably, auger 116 comprises proximal auger end-region 200 and distal auger end-region 202, as shown. Preferably, proximal auger end-region 200 is positioned generally adjacent power coupler 126, with distal auger end-region 202 positioned generally adjacent opening 198, as shown.

Preferably, paintballs 106 contacting first guide-wall 168 are guided by first guide ramp 203 (and by the sloping surfaces of first guide-wall 168) to positions of engagement within the concave interstitial spaces of helical flighting 122 (to the first guide-wall-side of longitudinal axis of rotation 120), as shown. These paintballs are favorably positioned for delivery to feed neck 112, as shown. Preferably, first guide ramp functions to control the angle and point of ball entry and preferably guides paintballs 106 located adjacent transverse guide wall assembly 144 to positions of engagement within the concave interstitial spaces of the first guide-wall-side of helical flighting 122, generally near proximal auger end-region. Preferably, first guide ramp 203 slopes downwardly from a high elevation generally adjacent distal auger end-region 202 to a low elevation terminating near about the midpoint of ball channel 172, as shown.

Preferably, paintballs 106 contacting second guide-wall 170 are guided by second guide ramp 206 (along with the sloping surfaces of second guide-wall 170) to positions of engagement within the concave interstitial spaces of the second guide-wall-side of helical flighting 122 (that is, the second guide-wall-side of longitudinal axis of rotation 120), as shown. If paintballs 106 have previously deposited within ball channel 172, and paintballs 106 are queued in distal channel area 208, paintballs 106 engaged within helical fighting 122 on the second guide-wall-side of longitudinal axis of rotation 120 are unfavorably positioned for delivery and are ejected from auger 116 (it should be noted that paintballs 106 engaged on the second guide-wall-side of longitudinal axis of rotation 120 drop to distal channel area 208 and are preferably conveyed to feedneck 112 when no paintballs 106 reside within the distal portion of ball channel 172).

Ejection of paintballs from auger 116 is preferably assisted by the contact interaction of paintballs 106 with ejection ramp 204, as shown. Preferably, ejection ramp 204 is integrally formed within the distal end of second guide-wall 170, as shown. Preferably, ejection ramp 204 is designed to lift paintballs 106 out of helical fighting 122 (to the right of longitudinal axis of rotation 120), as shown. The preferred upward slope of ejection ramp 204 (rising toward the forward transverse guide wall assembly 144) lifts paintballs 106 from auger 116 as they are driven toward transverse guide wall assembly 144, as shown. As the paintballs 106 collide with transverse guide wall assembly 144, they are ejected from auger 116 and are preferably relocated by transverse guide wall assembly 144 (assisted by the counter-clockwise rotation of auger 116) toward the first guide-wall-side of longitudinal axis of rotation 120, as best shown in FIG. 8 (at least embodying herein wherein such at least one relocator comprises, extending between such at least one first guide wall and such at least one second guide wall, at least one transverse guide wall structured and arranged to guide movement of the ejected paintballs between such at least one second side and such at least one first side; and wherein such at least one ball ejector comprises at least one contact interaction between the at least one paintball and such at least one transverse guide wall).

Once relocated, paintballs 106 previously ejected from auger 116 reside in an area of paintball storage compartment 110 generally favorable to the delivery of the relocated paintballs 106 to feedneck 112. More specifically, a significant portion of the relocated paintballs 106 will preferably reside in a favorable loading position adjacent first guide ramp 203 and are eventually guided by the wall structures to a favorable engagement within auger 116, as described above. Upon reading the teachings of this specification, those of ordinary skill in the art will now understand that, under appropriate circumstances, considering such issues as intended use, size of paintball, length of auger, etc., other loading arrangements, such as the use of additional ramps, ramps of alternate shapes, positions, etc., may suffice.

Figure 12:
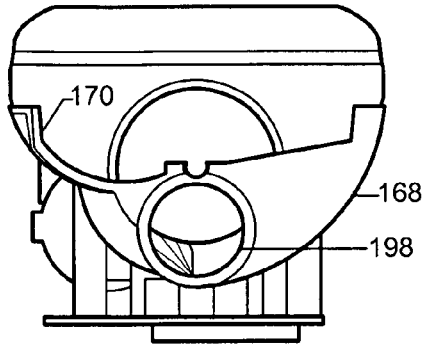
FIG. 12 shows a front view illustrating the removable loader tray of FIG. 5.
Figure 11:
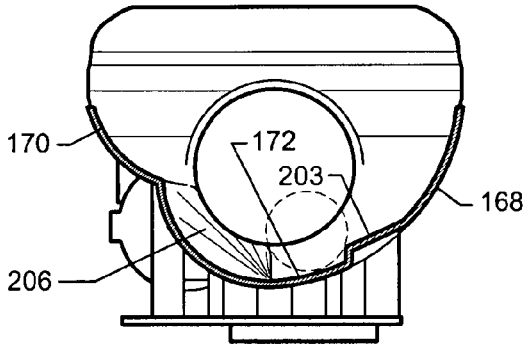
FIG. 11 shows the sectional view 11-11 of FIG. 10.

FIG. 11 shows the sectional view 11-11 of FIG. 10, generally illustrating a preferred cross-sectional shape of first guide wall 168, second guide wall 170, and channel 172. FIG. 12 shows a front view illustrating the relationship between first guide wall 168, second guide wall 170, and opening 198. Note that opening 198 is preferably located substantially within transverse guide wall assembly 144, as shown, and is preferably positioned directly below auger shaft 118 (and longitudinal axis of rotation 120).

Figure 14:
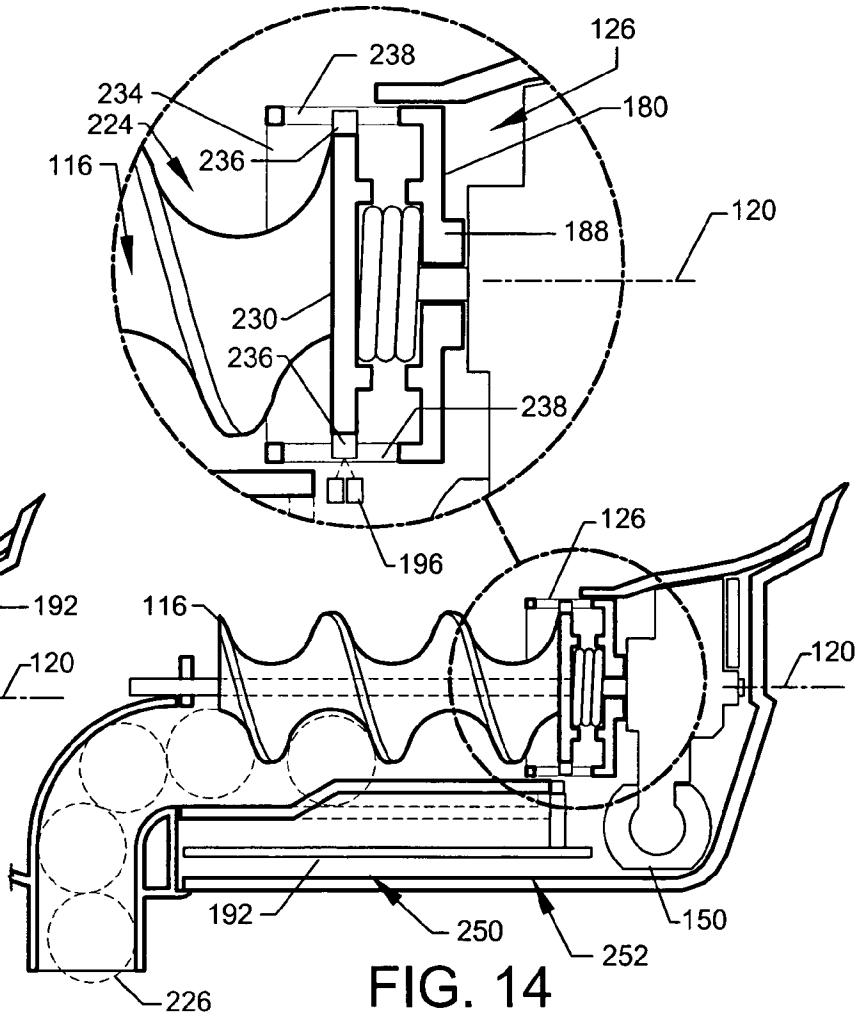
FIG. 14 shows a second longitudinal sectional view through the removable tray loader of FIG. 5, further illustrating the preferred operation of the power coupler assembly.
Figure 13:
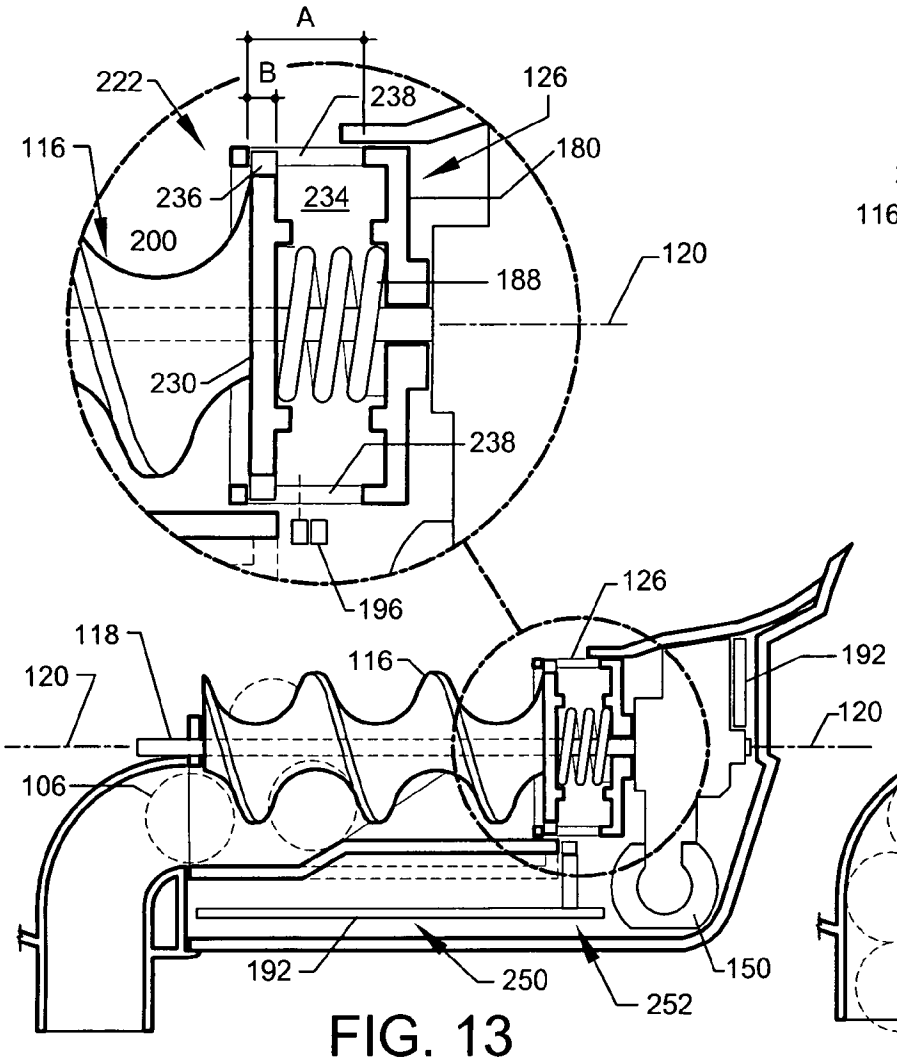
FIG. 13 shows a longitudinal sectional view through the removable tray loader of FIG. 5, illustrating the preferred operation of a preferred power coupler assembly according to the preferred embodiment of FIG. 1.

FIG. 13 shows a longitudinal sectional view through conveyor assembly 114 illustrating the preferred operation of power coupler 126 according to the preferred embodiment of FIG. 1. FIG. 14 shows a second longitudinal sectional view through conveyor assembly 114 further illustrating the preferred operation of power coupler 126.

It is important to coordinate the operation conveyor assembly 114 with the operation of paintball gun 104. When the user of paintball gun 104 ceases firing, the bolt of paintball gun 104 is closed, preventing paintballs from entering breach 108. When paintball gun 104 is in such an idle condition, is preferable to quickly reduce the amount of moving force applied to the ball stack. This quick reduction in the applied force prevents the sudden buildup of force levels that could break one or more paintballs within the stack. Paintball loader 102 efficiently satisfies this essential requirement by incorporating a disengager assembly 220 within power coupler 126.

Preferably, auger 116 is free to move axially along auger shaft 118 (coaxial with longitudinal axis of rotation 120) between at least one first position 222 (illustrated in FIG. 13), and at least one second position 224 (illustrated in FIG. 14). In first position 222, mechanical power is preferably delivered to auger 116. Preferably, disengager assembly 220 is structured and arranged to disengage auger 116 from the mechanical power when auger 116 is in second position 224.

Preferably, disengagement of auger 116 is initiated by a buildup of pressure within the ball stack of FIG. 14, identified herein as restricted ball stack 226. This buildup in pressure is expected when paintball gun 104 is idled, the bolt is closed, and auger 116 is rotating under the power of power assembly 124. Alternately, a buildup in pressure is expected when jam has occurred within the ball path. Preferably, a sufficient buildup in pressure results in the urging of auger 116 axially toward second position 224 (at least embodying herein, wherein such at least one auger is urged to such at least one second position in response to the development of at least one level of resistance force between the paintballs and such at least one auger). It is therefore preferred that power coupler 126 comprise a means for facilitating axial auger movement while maintaining the ability to transfer rotational torque between power assembly 124 and auger 116.

Preferably, proximal auger end-region 200 of auger 116 comprises end flange 230, as shown. Preferably, end flange 230 is rigidly coupled to auger 116, as shown. Preferably, lash cage 180 comprises a cup-shaped hollow cylindrical member having an interior bore 234 situated co-axially with longitudinal axis of rotation 120, as shown. Preferably, interior bore 234 is sized to movably receive end flange 230, as shown.

Preferably, end flange 230 comprises at least one interlocker, preferably a series of projecting tabs 236 structured and arranged to interlock end flange 230 with lash cage 180, as shown. Preferably, projecting tabs 236 are evenly distributed about the outer circumference of end flange 230, as shown. Preferably, lash cage 180 comprises a complementary distribution of longitudinal receiving slots 238 in which projecting tabs 236 engage, as shown. Preferably, receiving slots 238 are structured to allow axial movement of projecting tabs 236 (and the underlying end flange 230) relative to lash cage 180 (at least embodying herein wherein such at least one interlocker comprises at least one axial mover structured and arranged to allow axial movement of such at least one end flange relative to such at least one lash cage), as shown. Preferably, the engagement of projecting tabs 236 within longitudinal receiving slots 238 functions as a rotational coupler, coupling end flange 230 to lash cage 180, as shown (at least embodying herein wherein such at least one interlocker further comprises at least one rotational coupler structured and arranged to rotatably couple such at least one lash cage with such at least one end flange).

Preferably, each longitudinal receiving slot 238 comprises at least one longitudinal slot-length A at least greater than at least one longitudinal tab-thickness B of the engaged projecting tab 236, as shown. Furthermore, each longitudinal receiving slot 238 comprises at least one transverse slot-width substantially equal to at least one transverse tab-width of an engaged projecting tab 236. This preferred relationship enables axial movement of auger 116 relative to lash cage 180, but restricts relative radial movement between the two elements, as shown.

Preferably, auger 116 is positionally biased toward first position 222 by bias spring 188, as shown (at least embodying herein wherein such at least one power disengager comprises at least one positional biaser structured and arranged to bias such at least one auger toward such at least one first position). Preferably, bias spring 188, most preferably at least one helical spring, is situate coaxially with longitudinal axis of rotation 120, generally between end flange 230 and the rear wall of lash cage 180, as shown.

Preferably, the disengagement of auger 116 is by electrical control of electrically driven motor 150. Preferably, paintball loader 102 comprises at least one electrical circuit 250 to conduct electrical power between batteries 147 and electrically driven motor 150 (see subcomponents of FIG. 4 and FIG. 7). Preferably, electrical circuit 250 comprise at least one electrical control 252 functioning to control the conduction of current between batteries 147 and electrically driven motor 150. Preferably, electrical control 252 comprises sensor unit 196 (see also FIG. 7) adapted to sense the position of auger 116. Preferably, sensor unit 196 enables the conduction of the electrical current between batteries 147 and electrically driven motor 150 when auger 116 is in first position 222. Preferably, sensor unit 196 disables the conduction of the electrical current between batteries 147 and electrically driven motor 150 when auger 116 is in second position 224. Preferably, sensor unit 196 is adapted to detect the position of end flange 230 and/or portion of auger 116 within lash cage 180, as shown. Preferably, sensor unit 196 comprises an emitter/receiver pair that is preferably positioned adjacent power coupler 126, as shown. Upon reading the teachings of this specification, those of ordinary skill in the art will now understand that, under appropriate circumstances, considering such issues as cost, intended use, etc., other disconnect arrangements, such as mechanical systems, clutch systems, magnetic systems, etc., may suffice.

Preferably, additional control of the operation of paintball loader 102 is provided by an embedded microprocessor, or microcontroller, preferably located on main electronics board 192. User interface electronics board 194 preferably interoperates with main electronics board 192 to provide user control of the onboard programming supported by the embedded microprocessor. Preferably, user interface electronics board 194 comprise at least one visual display, most preferably an illuminated light emitting diode (LED) display 254, as shown. Preferably, user interface electronics board 194 further comprises at least one user input, preferably comprising a set of momentary contact switches 256, as shown. Upon reading the teachings of this specification, those of ordinary skill in the art will now understand that, under appropriate circumstances, considering such issues as intended use, advances in technology, etc., other interface arrangements, such as wireless interfaces, two-way data ports, insertable electronic media, data logging features, etc., may suffice.

For high levels of loading performance, it is preferred to maintain a level of force on the queued stack of paintballs 106 at all times. Preferably, this application of force should be applied continuously, even while the user is not firing.

Preferably, bias spring 188 also functions to maintain continuous pressure on the ball stack, even when auger 116 is not spinning. This constant pressure assures that a paintball 106 is driven into breech 108 the moment the bolt of paintball gun 104 is opened sufficiently to pass the ball, even before electrically driven motor 150 is activated. Upon reading the teachings of this specification, those of ordinary skill in the art will now understand that, under appropriate circumstances, considering such issues as intended use, cost, etc., other force generation arrangements, such as motor tensioning with variable torque controls, stepper motors with electronic controls, etc., may suffice.

Preferably, paintball loader 102 is constructed from one or more durable and lightweight materials with the substantial use of rigid plastics being generally preferred. Portions of preferred embodiments of paintball loader 102 may be constructed from transparent or translucent materials to provide an indication of the interior of the loader.

Figure 15:
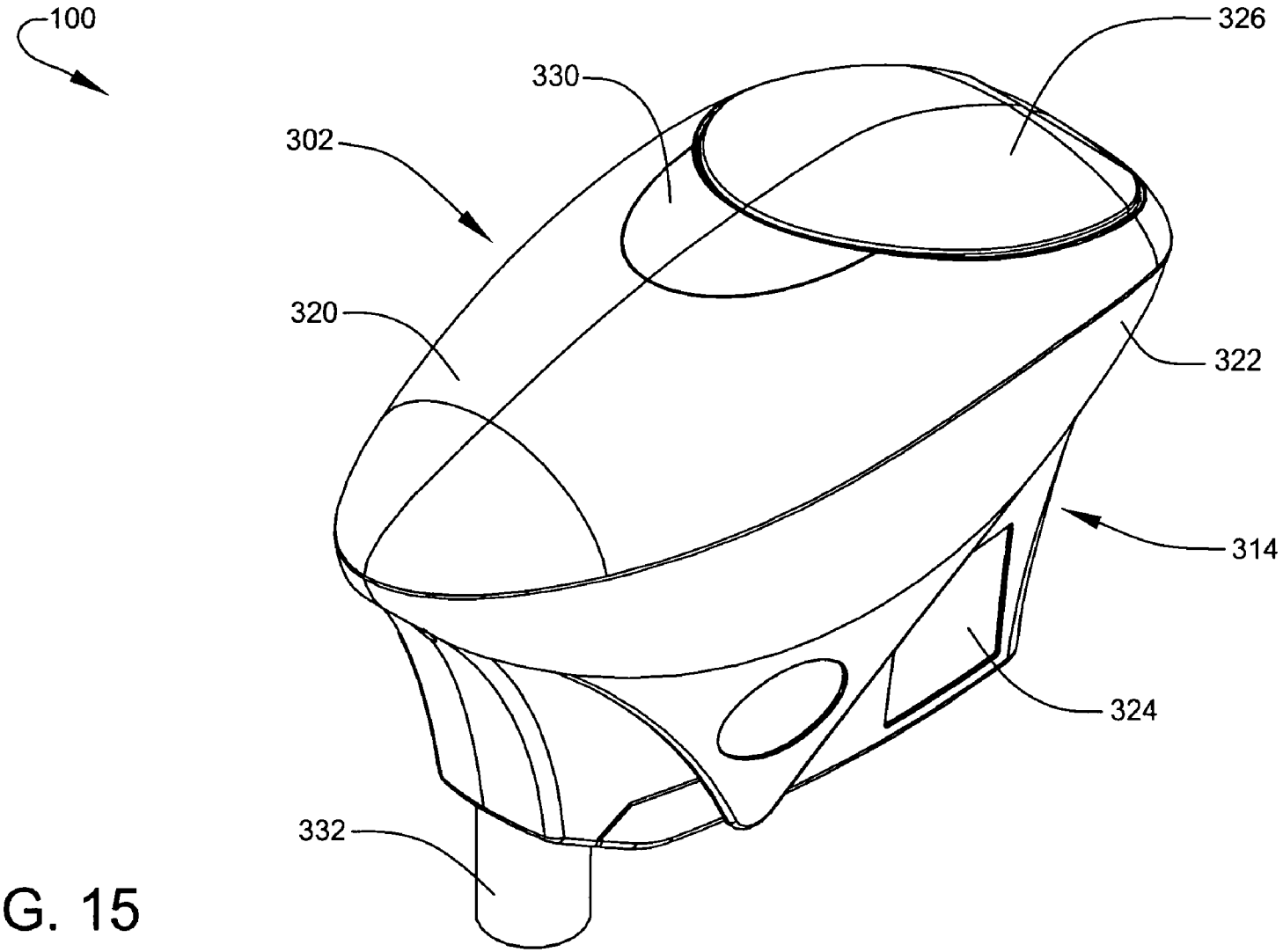
FIG. 15 shows a perspective view of an alternate paintball loader according to another preferred embodiment of the present invention.

FIG. 15 shows a perspective view of alternate paintball loader 302 according to another preferred embodiment of loader system 100. Preferably, alternate paintball loader 302 comprises a number of enhancements over the above-described paintball loader 102. Alternate paintball loader 302 is preferably designed not only to rapidly deliver a plurality of paintballs to the breach of paintball gun 104, but to do so in a manner that reduces force loads on the surface of the paintballs while reducing power demand on the onboard batteries. These preferred features are enabled through material selection, incorporation of adaptive loading structures, and development of sensor-enabled software controls, as described below.

Figure 16:
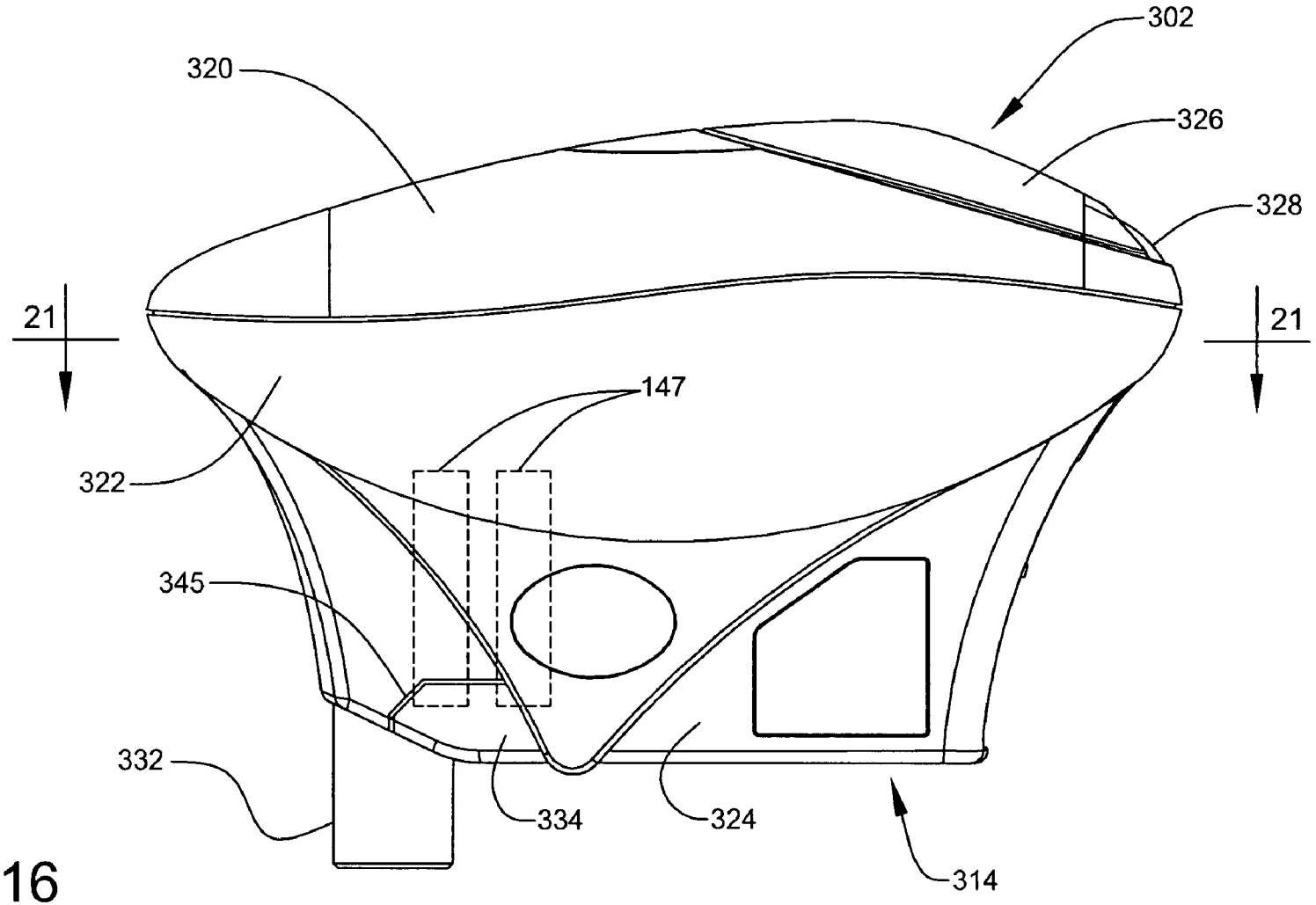
FIG. 16 shows a side view of the alternate paintball loader according to the preferred embodiment of FIG. 15.
Figure 17:
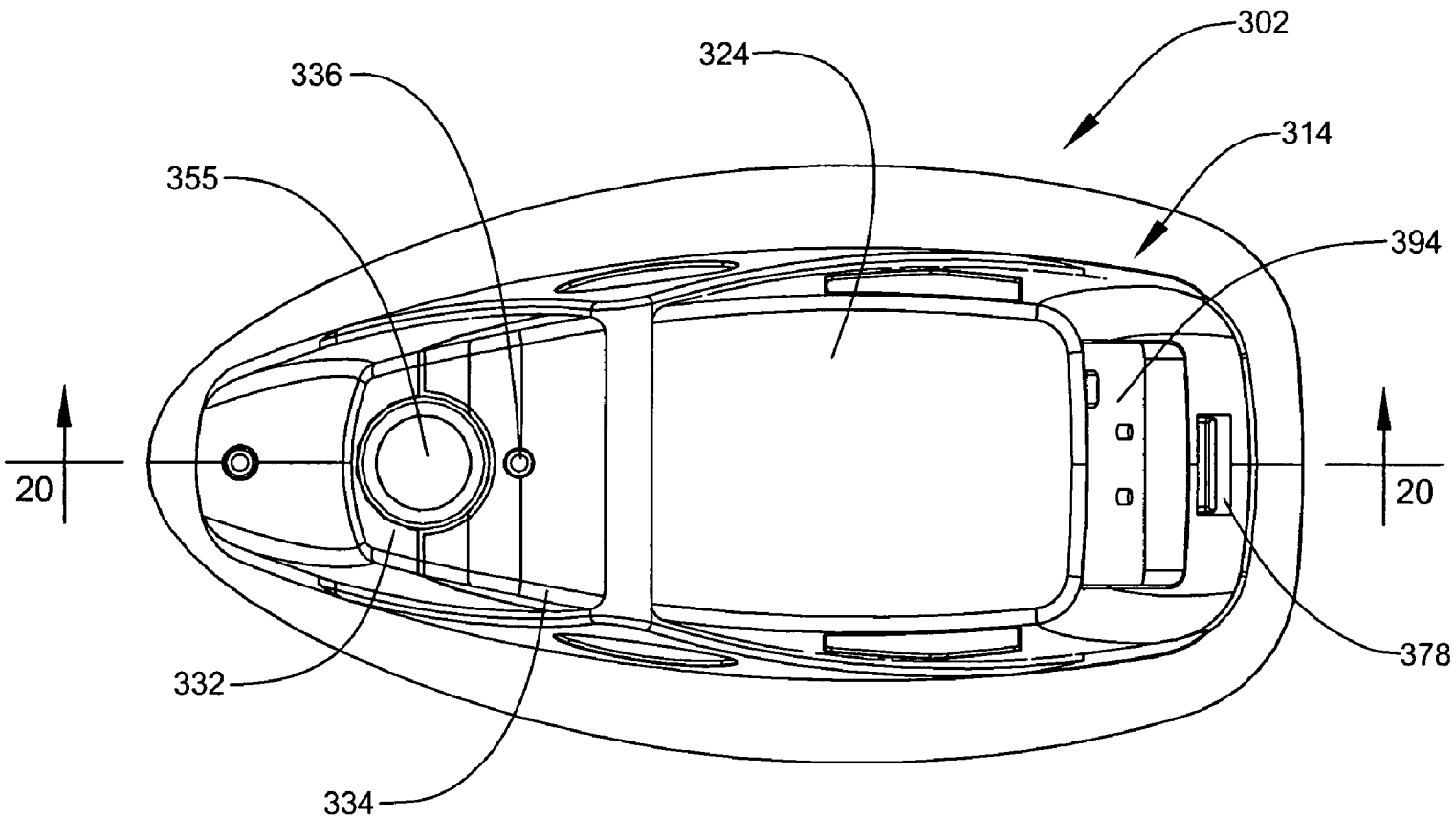
FIG. 17 shows a bottom view of the alternate paintball loader according to the preferred embodiment of FIG. 15.
Figure 18:
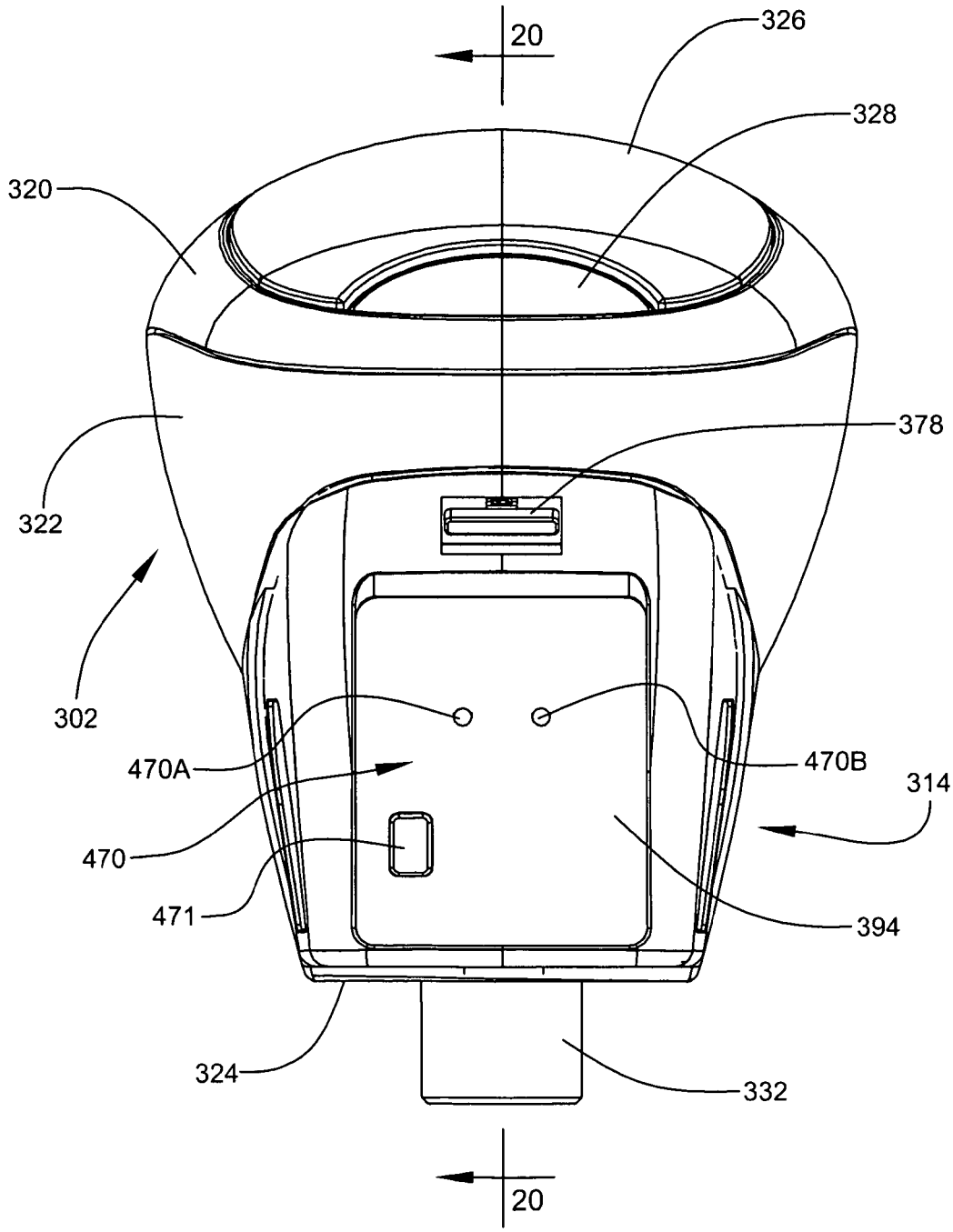
FIG. 18 shows a rear view of the alternate paintball loader according to the preferred embodiment of FIG. 15.

FIG. 15 through FIG. 18 illustrate preferred external features of alternate paintball loader 302. FIG. 16 shows a side view of alternate paintball loader 302, FIG. 17 shows a bottom view of alternate paintball loader 302, and FIG. 18 shows a rear view of alternate paintball loader 302.

Figure 19:
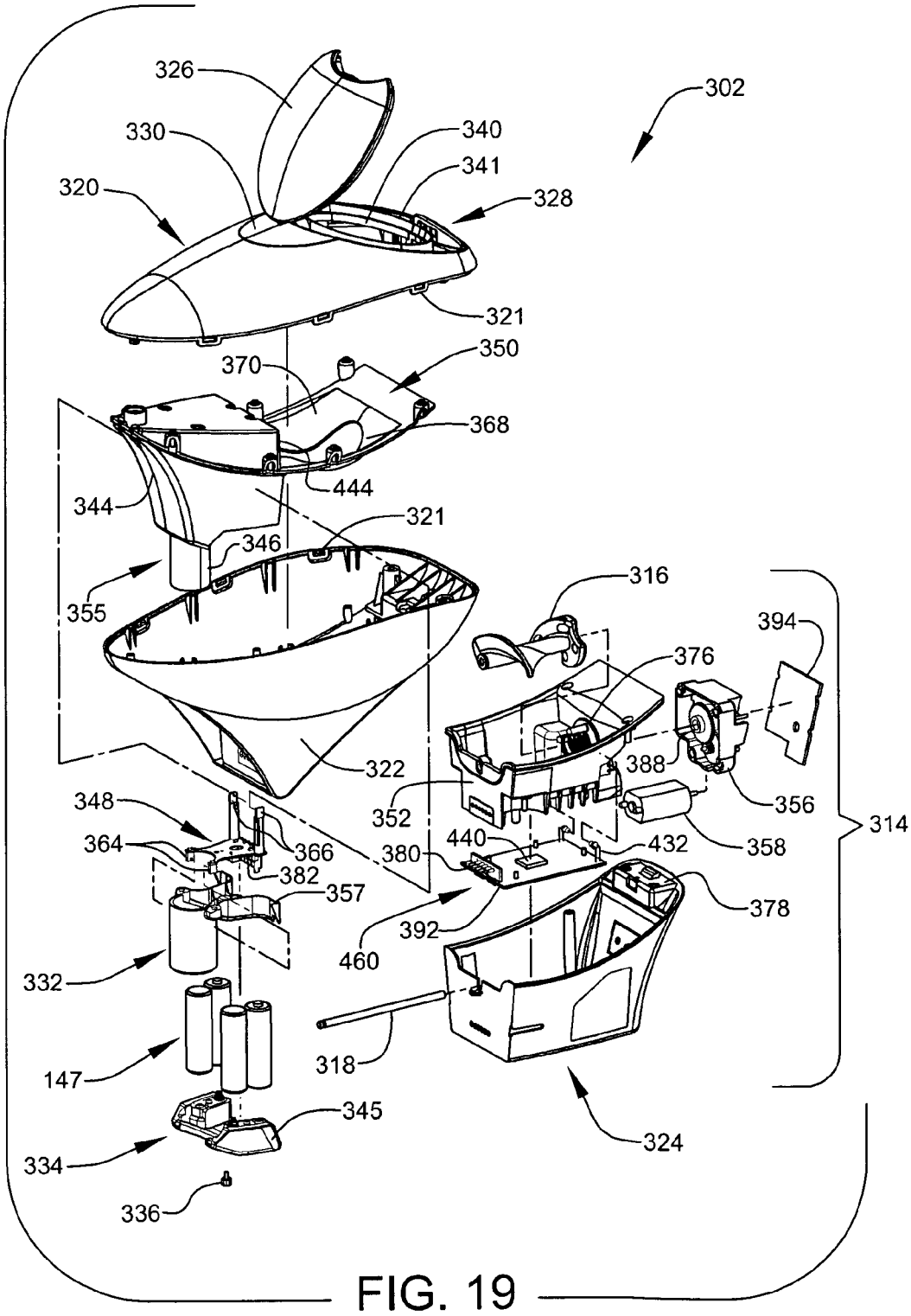
FIG. 19 shows an exploded view of the alternate paintball loader of FIG. 15 showing preferred internal components.
Figure 20:
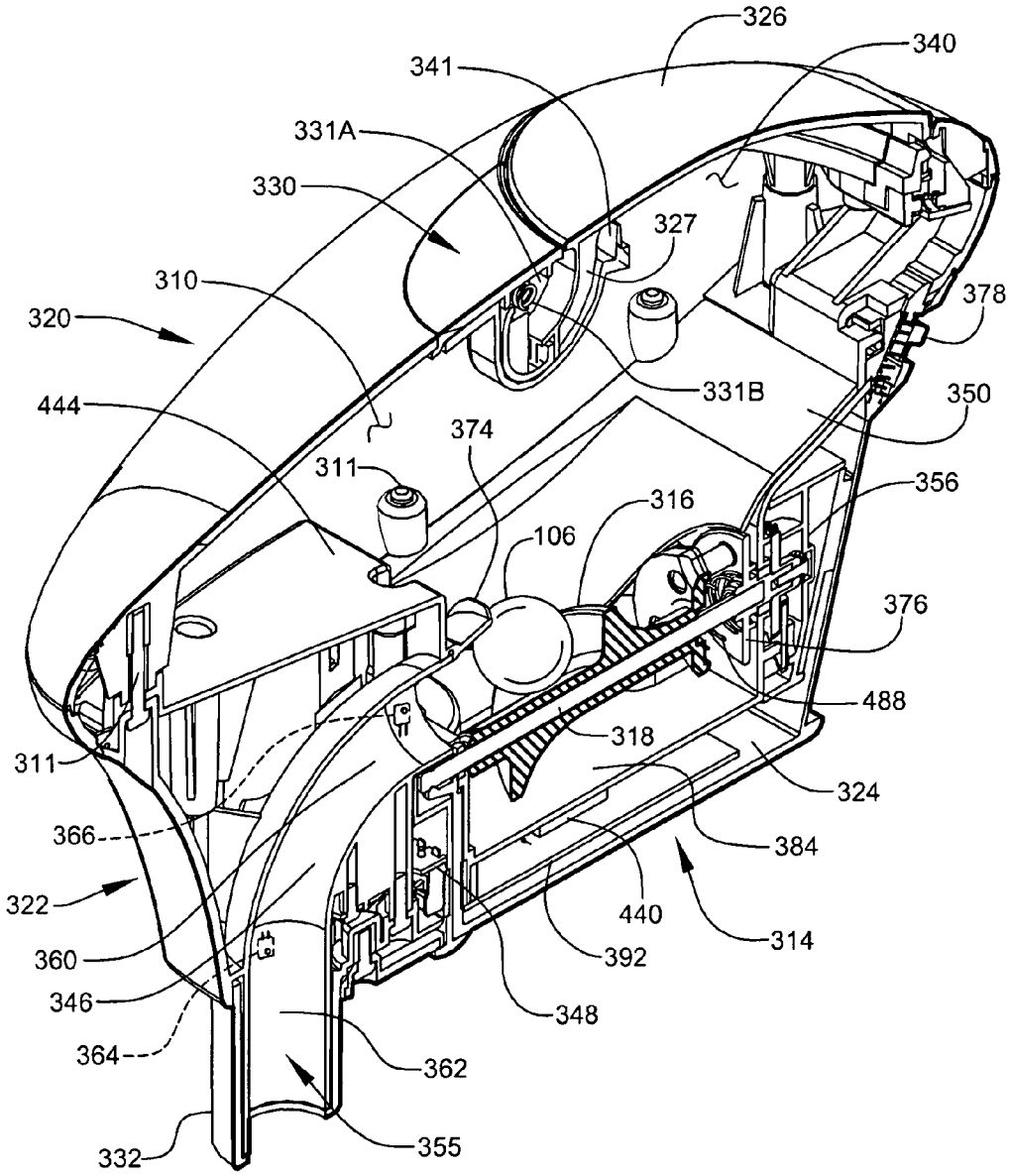
FIG. 20 shows a sectional view through the section 20-20 of FIG. 17. showing preferred internal component arrangements of an assembled alternate paintball loader.

FIG. 19 shows an exploded view of the alternate paintball loader of FIG. 15 showing both external and internal components making up the embodiment. FIG. 20 shows a sectional view through the section 20-20 of FIG. 17 showing preferred external and internal component arrangements of an assembled alternate paintball loader 302. Reference is now made to FIG. 15 through FIG. 20 with continued reference to the prior figures.

Alternate paintball loader 302 comprises a preferred arrangement of external components including upper shell 320, lower shell 322, auger drive tray assembly 314, lid 326, lid release assembly 328, lid spring assembly 330, one-piece outer feed neck 332, battery cover 334, battery door screw 336, and user interface board 338, as shown.

The preferred outer form-factor (shape) of alternate paintball loader 302 is generally aerodynamic in character, as shown, preferably being more slender in the front (above feed neck 332) to increase the chance of safely deflecting an incoming paintball without breakage. Preferably, alternate paintball loader 302 comprises a forward-neck design meaning that one-piece outer feed neck 332 is positioned toward the front portion of the loader. The preferred forward-neck design assists in providing a reduced target profile during use with paintball gun 104, thus assisting a user during competitive play.

To assist in balancing the weight of such a forward-neck design, the principal mass of the embodiment is preferably concentrated toward one-piece outer feed neck 332. As the onboard batteries comprise a substantial portion of the overall weight of the operating loader, batteries 147 are preferably located in a forward position within alternate paintball loader 302, as shown in the dashed-line depiction of FIG. 16. Preferably, battery compartment 344 is located directly above and adjacent one-piece outer feed neck 332, as shown, to assist in providing a generally neutral weight distribution.

Preferably, battery compartment 344 is adapted to hold at least one electrical power source, most preferably one or more batteries 147 used to supply direct current to electrically driven motor 358. Preferably, batteries 147 are of an expendable or rechargeable (secondary) type.

Preferably, battery compartment 344 comprises a removable battery cover 334, as shown. Preferably, battery cover 334 is retained on battery compartment 344 by battery door screw 336, preferably comprising a thumbscrew, preferably adapted to be removable without tools. Preferably, battery cover 334 is removed from the battery compartment 334 by unscrewing battery door screw 336. Battery door screw 336 is preferably retained within the cover by a d-ring retainer to prevent loss. Preferably, once battery door screwed 336 is released, battery cover 334 may be removed from battery compartment 334 to expose batteries 147.

Preferably, battery cover 334 comprises an elastomeric battery door seal 345 overlaying the interior face of the cover, as shown. Preferably, elastomeric battery door seal 345 protects the battery compartment against infiltration of moisture and functions to support the lower electrical contacts for batteries 147. In addition, elastomeric battery door seal 345 partially surrounds and protects one-piece outer feed neck 332 against impact damage by dampening impact forces imparted to the neck.

Preferably, upper shell 320 comprises a generally circular access opening 340 used to refill paintball storage compartment 310. Lid 326 preferably functions to cover access opening 340 during operation to prevent loss of paintballs and to prevent entry of debris during use. Preferably, lid 326 is spring-loaded such that, on depressing lid release assembly 328, lid 326 "springs" to the open position of FIG. 19, allowing rapid reloading of paintball storage compartment 310. Preferably, lid 326 comprises an arcuate pivot arm 327 that is pivotally coupled to upper shell 320 at a point within lid spring assembly 330, as shown. Lid spring assembly 330 preferably comprises a pivot coupler 331A, to couple lid 326 to upper shell 320, and bias spring 331B acting between upper shelf 320 and lid 326, as shown.

Preferably, access opening 340 is further protected by a recessed moisture shedding channel 341 formed within upper shell 320, as shown. Preferably, the peripherally located moisture shedding channel 341 is designed to channel moisture away from access opening 340, thus extending the usefulness of the system to rainy or muddy operation. Upon reading the teachings of this specification, those of ordinary skill in the art will now understand that, under appropriate circumstances, considering such issues as intended use, etc., other arrangements, such as the use of moisture resistant seals, structures designed to interface with specific speed-loading devices, etc., may suffice.

Figure 23:
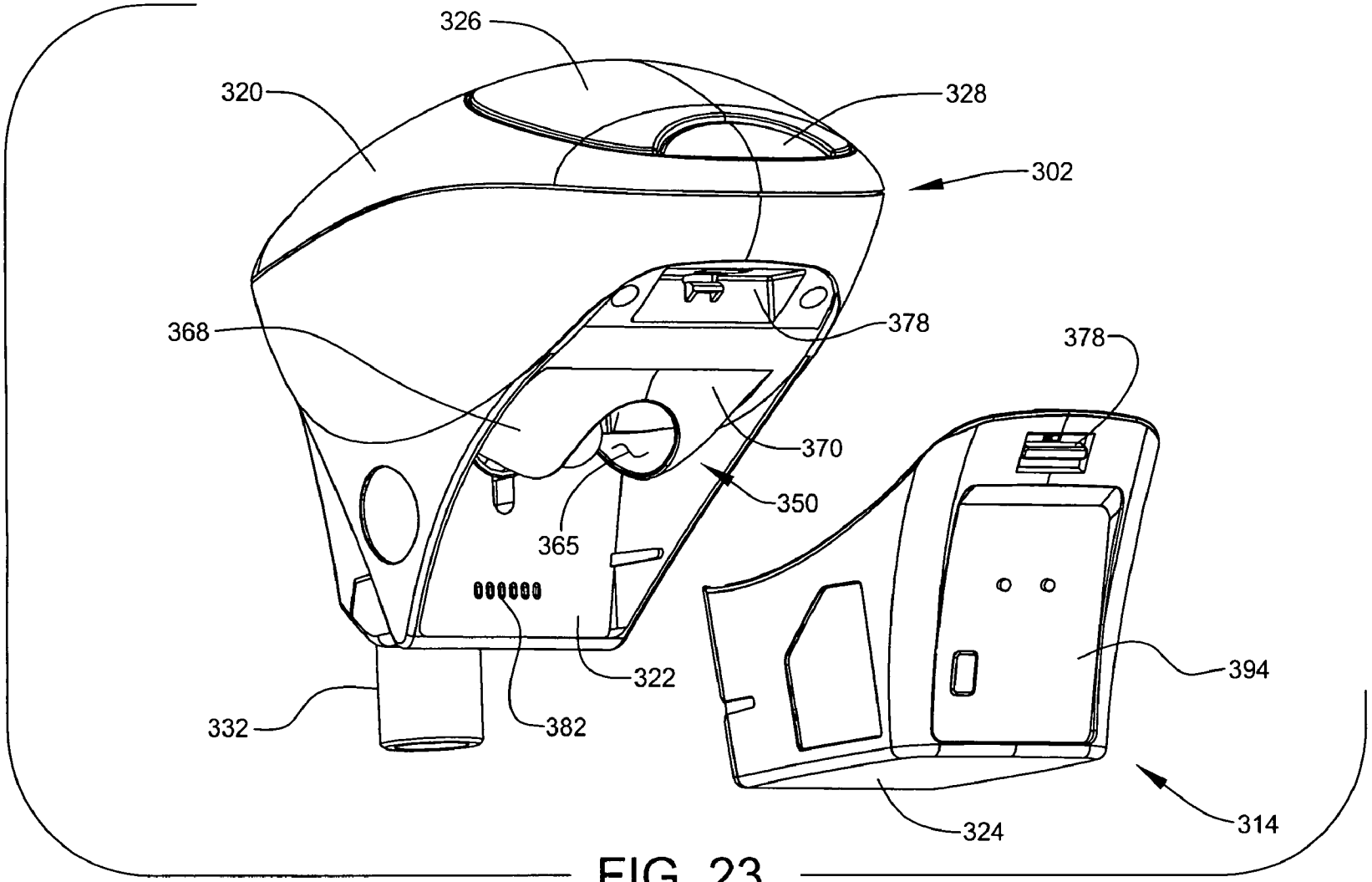
FIG. 23 shows another rear view of the alternate paintball loader with a removable auger tray in a removed position according to the preferred embodiment of FIG. 15.

Preferably, auger drive tray assembly 314 is removable from lower shell 322 for cleaning and service, as further described in FIG. 23. Preferably, the operable components of auger drive tray assembly 314 are contained within auger drive outer housing 324, as shown. Preferably, the rear portion of auger drive outer housing 324 comprises a user accessible control panel identified herein as user interface electronics board 394, as shown. Preferably, user interface electronics board 394 interoperates with main electronics board 392 to provide user control of the onboard programming supported by an embedded microprocessor, as further described in a later section.

Auger drive tray assembly 314 preferably comprises a preferred arrangement of internal components preferably including auger 316, auger support shaft 318, power coupler 376, inner support tray 352, main electronics board 392, gearbox 356, and motor 358, as shown.

Alternate paintball loader 302 further comprises a preferred arrangement of internal components preferably including ball floor 350, transparent feed-tube section 346 (see FIG. 22A), and front sensor board 348, as shown. Preferably, battery compartment 344 further comprises an upper half of an interior feed-tube sleeve 355. This portion of feed-tube sleeve 355 is preferably flanked by a set of integrally-molded battery chambers 353, each one preferably adapted to maintain the position of batteries 147 within the battery compartment 344 (see FIG. 22A). Transparent feed-tube section 346 preferably comprises the lower half of feed-tube sleeve 355, as shown. In addition, transparent feed-tube section 346 preferably comprises a set of wall portions 354 designed to complete the encapsulation of batteries 147 within battery chambers 353. Together, transparent feed-tube section 346 and battery compartment 344 define internal feed-tube sleeve 355, which preferably sweeps an arcuate pathway extending between paintball storage compartment 310 and the interior bore of one-piece outer feed neck 332, as shown.

Figure 30:
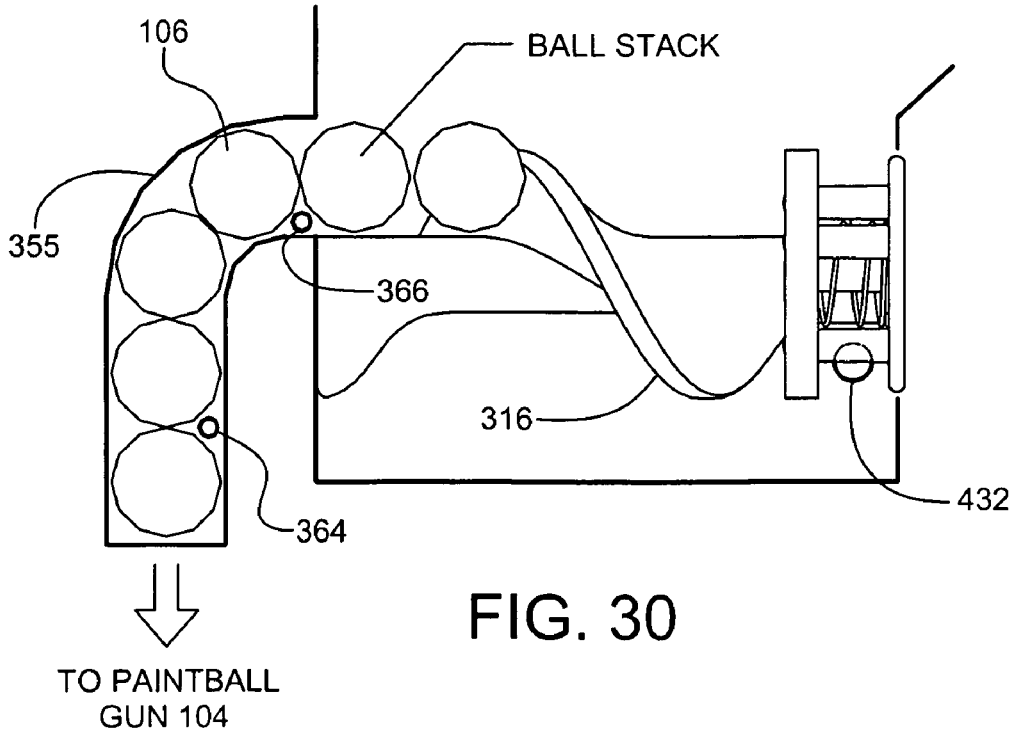
FIG. 30 shows a diagrammatic side view of a preferred sensor positioning within the alternate paintball loader of FIG. 15.

Preferably, feed-tube sleeve 355, when assembled, comprises a smooth hollow cylindrical channel structured and arranged to channel paintballs 106 to paintball gun 104 in substantially single-file alignment (see the diagram of FIG. 30). Preferably, feed-tube sleeve 355 comprises a generally horizontal paintball entry portion 360 located proximally of paintball storage compartment 310, and a generally vertical paintball exit portion 362 located downstream of paintball entry portion 360, as shown.

Preferably, front sensor board 348 comprises a set of flow detectors adapted to detect the flow of paintballs within two regions of feed-tube sleeve 355. Preferably, front sensor board 348 comprises two separate ball-flow sensor arrays identified herein as first detection unit 364 and second detection unit 366. Preferably, first detection unit 364 is positioned to detect a flow of paintballs within the lower paintball exit portion 362, as shown. Preferably, second detection unit 366 is positioned to detect a flow of paintballs within upper paintball entry portion 360, as shown.

Preferably, front sensor board 348 is situated adjacent transparent feed-tube section 346, preferably between feed-tube section 346 and the rearward projecting mounting flange 357 of one-piece outer feed neck 332, as shown. Preferably, first detection unit 364 and second detection unit 366 each comprises a matched emitter and detector pair, respectively positioned on opposite sides of transparent feed-tube section 346 (see FIG. 29 and FIG. 30). Preferably, the emitter of each matched emitter/detector pair generates a beam that projects through the transparent feed-tube section 346 to the corresponding detector. Preferably, first detection unit 364 and second detection unit 366 each comprises an infrared (IR) emitter/detector pair preferably utilizing an infrared beam. Preferably, first detection unit 364 and second detection unit 366 are electrically coupled with the control circuits of main electronics board 392.

Preferably, as paintballs pass within transparent feed-tube section 346, the IR beam is momentarily interrupted, resulting in a change of detector output voltage that is preferably registered at main electronics board 392. Preferably, the patterns of voltage changes within the detection units allow the microcontroller to determine ball flow within alternate paintball loader 302, preferably using embedded system software. Flow data is preferably used by the system software to adjust and optimize the rotation of auger 316, as further described below.

Preferably, the sensors of both first detection unit 364 and second detection unit 366 are fully separated from the interior of feed-tube sleeve 355 by transparent feed-tube section 346. This highly preferred feature shields the sensors from paint and debris that could otherwise hinder ball-flow detection. In the event of broken paint within feed-tube sleeve 355, it is a simple matter to clear the detector "eyes" by pulling a jerk-type squeegee through feed-tube sleeve 355. This preferred cleaning process is further facilitated by the removal of auger drive tray 314 from lower shell 322, as further described in FIG. 23.

Figure 22A:
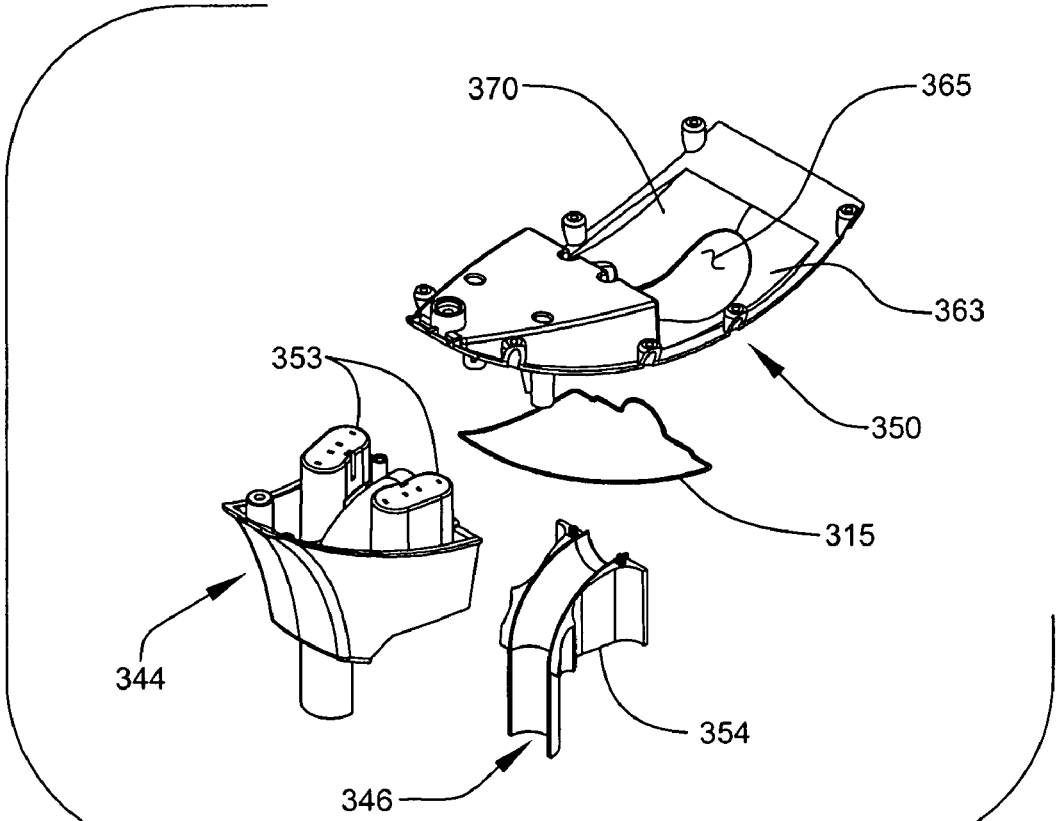
FIG. 22A shows an exploded view of the front internal components of the alternate paintball storage compartment according to the preferred embodiment of FIG. 15.

Preferably, ball floor 350 is secured to battery compartment 344 and lower shell 322, preferably using mechanical-type fasteners 311, as shown. Preferably, alternate paintball loader 302 is assembled using a plurality of moisture-resistant seals 315, as best shown in FIG. 22A. Preferably, moisture-resistant seals 315 are located to limit the intrusion of paint, moisture, and dirt within sensitive areas of the loader.

Preferably, upper shell 320 and lower shell 322 are removably joined using a corresponding set of snap-together couplers 321, as shown. Preferably, upper shell 320 and lower shell 322 are further retained by one or more mechanical-type fasteners 311, as shown. Together, upper shell 320, lower shell 322 and ball floor 350 define paintball storage compartment 310, as shown.

Figure 21:
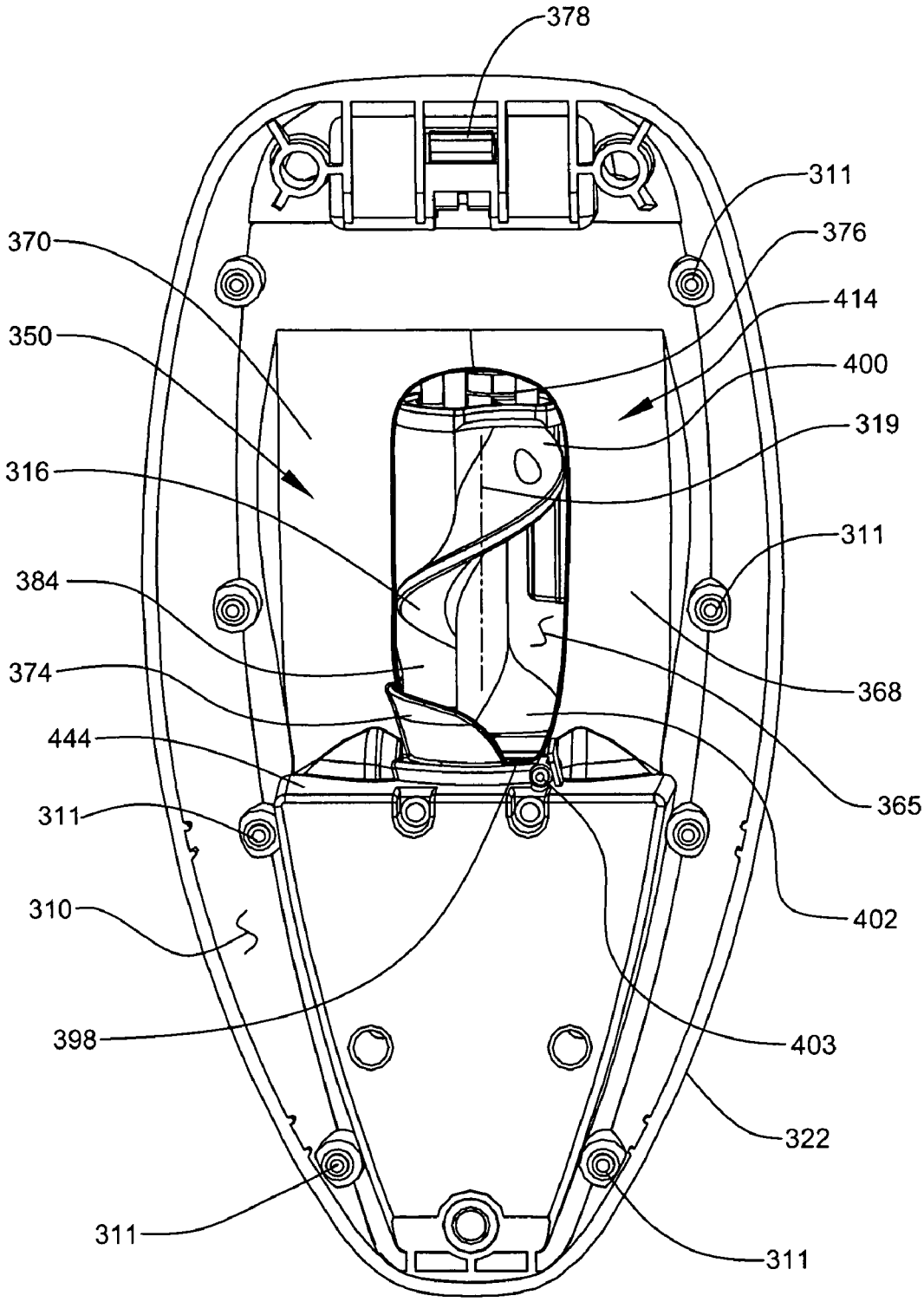
FIG. 21 shows the sectional view 21-21 of FIG. 16 according to the preferred embodiment of FIG. 15 illustrating a preferred alternate paintball storage compartment.
Figure 22B:
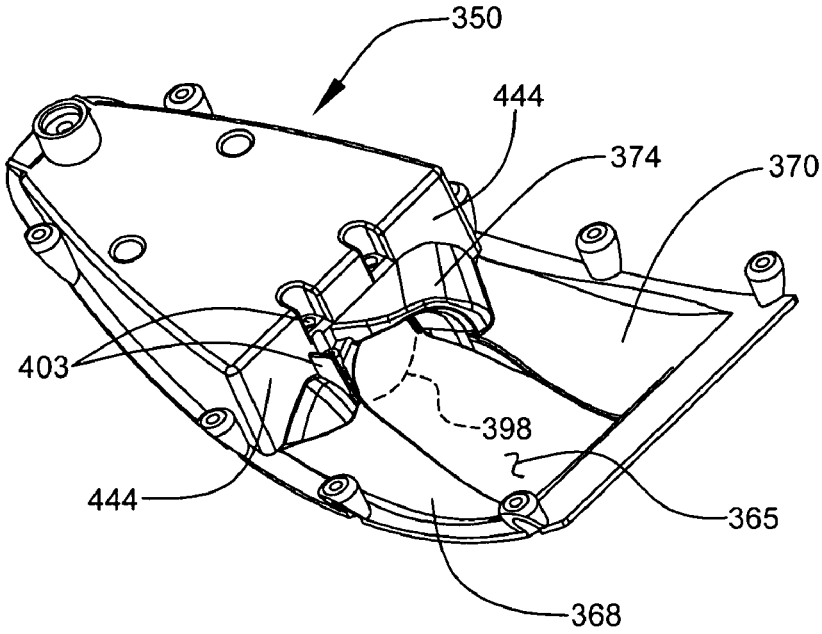
FIG. 22B shows a perspective view of the ball floor structure according to the preferred embodiment of FIG. 15.

FIG. 21 shows the sectional view 21-21 of FIG. 16 according to the preferred embodiment of FIG. 15 illustrating lower shell 322 containing ball floor 350 and auger 316 of paintball storage compartment 310. FIG. 22A shows an exploded view of the front internal components of paintball storage compartment 310. FIG. 22B shows a perspective view of ball floor 350 according to the preferred embodiment of FIG. 15.

Ball floor 350 of paintball storage compartment is preferably adapted to guide paintballs 106 toward auger 316, as shown. For clarity, the combination of ball floor 350 and auger 316 are identified herein as conveyor assembly 414

Preferably, auger 316 comprises proximal auger end-region 400 and distal auger end-region 402, as shown. Preferably, proximal auger end-region 400 is positioned generally adjacent power coupler 376, with distal auger end-region 402 positioned generally adjacent feed-tube opening 398, as shown.

Preferably, ball floor 350 comprises a bowl-shaped structure defined by a plurality of guide walls generally identified herein as first guide-wall 368, second guide-wall 370, and transverse guide wall assembly 444, as shown. Preferably, all surfaces of ball floor 350 are sloped toward auger 316. Preferably, first guide-wall 368 is structured and arranged to guide paintballs 106 toward a first side of auger 316, and second guide-wall 370 structured and arranged to guide paintballs toward a second side of auger 316, as shown. Preferably, ball floor 350 comprises auger opening 365 to allow first guide-wall 368 and second guide-wall 370 to be positioned flanking opposing sides of auger 316, as shown. Transverse guide wall assembly 444 extends between first guide-wall 368 and second guide-wall 370 and comprises an accommodation for feed-tube opening 398, as shown. Feed-tube opening 398 preferably provides access to internal feed-tube sleeve 355, as shown.

Guide wall assembly 444 preferably comprises a projecting guide hood 374, preferably surrounding feed-tube opening 398, as shown. Preferably, guide hood 374 assists in guiding paintballs 106 engaged within auger 316 through feed-tube opening 398. Preferably, guide hood 374 is positioned adjacent the second guide-wall 370, as shown. Preferred embodiments of guide wall assembly 444 also comprises a built-in attachment point 403 for supporting additional structures adjacent feed-tube opening 398. This preferably allows a user to temporarily modify the feed characteristics of the loader, for example, to accommodate a specific type of play, ball type, etc. Upon reading the teachings of this specification, those of ordinary skill in the art will now understand that, under appropriate circumstances, considering such issues as intended use, etc., other paintball storage compartment arrangements, such as the mounting of additional sensors, mounting of alternate ball guides, etc., may suffice.

Preferably, paintballs 106 contacting first guide-wall 368 and second guide-wall 370 are guided to positions of engagement within the concave interstitial spaces of helical flighting 372 of auger 316. Preferably, paintballs 106 engaged within helical flighting 372 are actively conveyed toward feed-tube opening 398 of internal feed-tube sleeve 355, by the rotation of auger 316. Preferably, the distance between helical flighting 372 of auger 316 has been increased such that two paintballs 106 may be accommodated within each flight. Field testing has demonstrated that such extended auger flighting increases the rate at which auger 316 feeds paintballs 106, at all rotational speeds, when compared to a single-ball-per-flight configuration.

A preferred feature of conveyor assembly 414 is the ability to selectively manipulate paintballs within paintball storage compartment 310 to provide improved loading consistency. Preferably, conveyor assembly 414 is designed to perform a first selection process wherein paintballs 106, favorably positioned for loading, are conveyed by auger 316 to feed-tube opening 398. In a second preferred selection process, conveyor assembly 114 is preferably designed to eject paintballs 106 unfavorably positioned for delivery to feed-tube opening 398 from conveyor assembly 414.

As the paintballs 106 intersect with transverse guide wall assembly 444, they are either captured under projecting guide hood 374 and guided toward feed-tube opening 398, or alternatively, are ejected from auger 316. A quantity of ejected paintballs 106 are relocated by transverse guide wall assembly 444 (assisted by the rotation of auger 316) toward either first guide-wall 368 or second guide-wall 370. In alternate paintball loader 302, paintballs 106 engaging either side of auger axis of rotation 319 may comprise a favorable position allowing conveyance by auger 316 to feed-tube opening 398. Preferably, ejection of the paintballs further functions to continuously agitate the plurality of paintballs contained within paintball storage compartment 310 to further improve loading. Upon reading the teachings of this specification, those of ordinary skill in the art will now understand that, under appropriate circumstances, considering such issues as intended use, size of paintball, length of auger, etc., other loading arrangements, such as the use of additional ramps, walls of alternate shapes, positions, etc., may suffice.

FIG. 23 shows another rear view of alternate paintball loader 302, illustrating auger drive tray 314 in a removed position, according to the preferred embodiment of FIG. 15. One of the highly preferred features of both paintball loader 102 and alternate paintball loader 302 is ease of cleaning afforded by the removal feature of the auger drive tray.

An issue common to most paintball players is the difficulty of cleaning a loader after use. Paintball loaders are subject to occasional paintball breakage due to the occasional "off-specification" paintball. Preferred features of alternate paintball loader 302 make such rare but occasional breakage of a paintball, within paintball storage compartment 310, particularly easy to manage.

Preferably, auger drive tray 314 is slidably engaged within a lower rear opening of lower shell 322, as shown. This preferred detachment feature allows the entire auger drive tray 314 to be removed from lower shell 322 for inspection and cleaning. Preferably user-operated locking assembly 378 maintains auger drive tray 314 within lower shell 322 during use. A set of projecting electrical conducting pins 380 (see FIG. 24) and a corresponding set of conducting pads 382 provide a means for electrically coupling front sensor board 348/batteries 147 and the electrical components of auger drive tray 314 when the auger drive tray is in the assembled configuration. Preferably, projecting electrical conducting pins 380 are spring-loaded to assist the maintaining of positive electrical contact.

Preferably, to remove auger drive tray 314, the user simply disengages locking assembly 378, and pulls the tray away from lower shell 322. Cleaning of the individual drive components of auger drive tray 314 is further facilitated by the ability to remove auger 316 from auger drive tray 314, as illustrated in FIG. 24.

The preferred removability of auger drive tray 314 enables an additional preferred feature of alternate paintball loader 302. Preferably, the area below auger 316, within auger drive tray 314, comprises debris tray 384, as shown (at least embodying herein at least one catch tray located gravitationally below such at least one rotatable auger). Preferably, debris tray 384 is designed to catch and retain debris generated within paintball storage compartment 310. Preferably, such debris passes through auger opening 365 by falling around auger 316. Preferably, the space formed between the peripheral edge of auger opening 365 and auger 316 is sufficiently narrow to prevent paintballs 106 from falling through during typical operation. However, debris such as broken paintballs, dirt, gravel, etc., having a size smaller than the outer diameter of paintballs 106, preferably fall through auger opening 365 to be collected within debris tray 384. This preferred feature assists in maintaining normal operation of paintball gun 104 despite the development of debris within paintball storage compartment 110.

Figure 24:
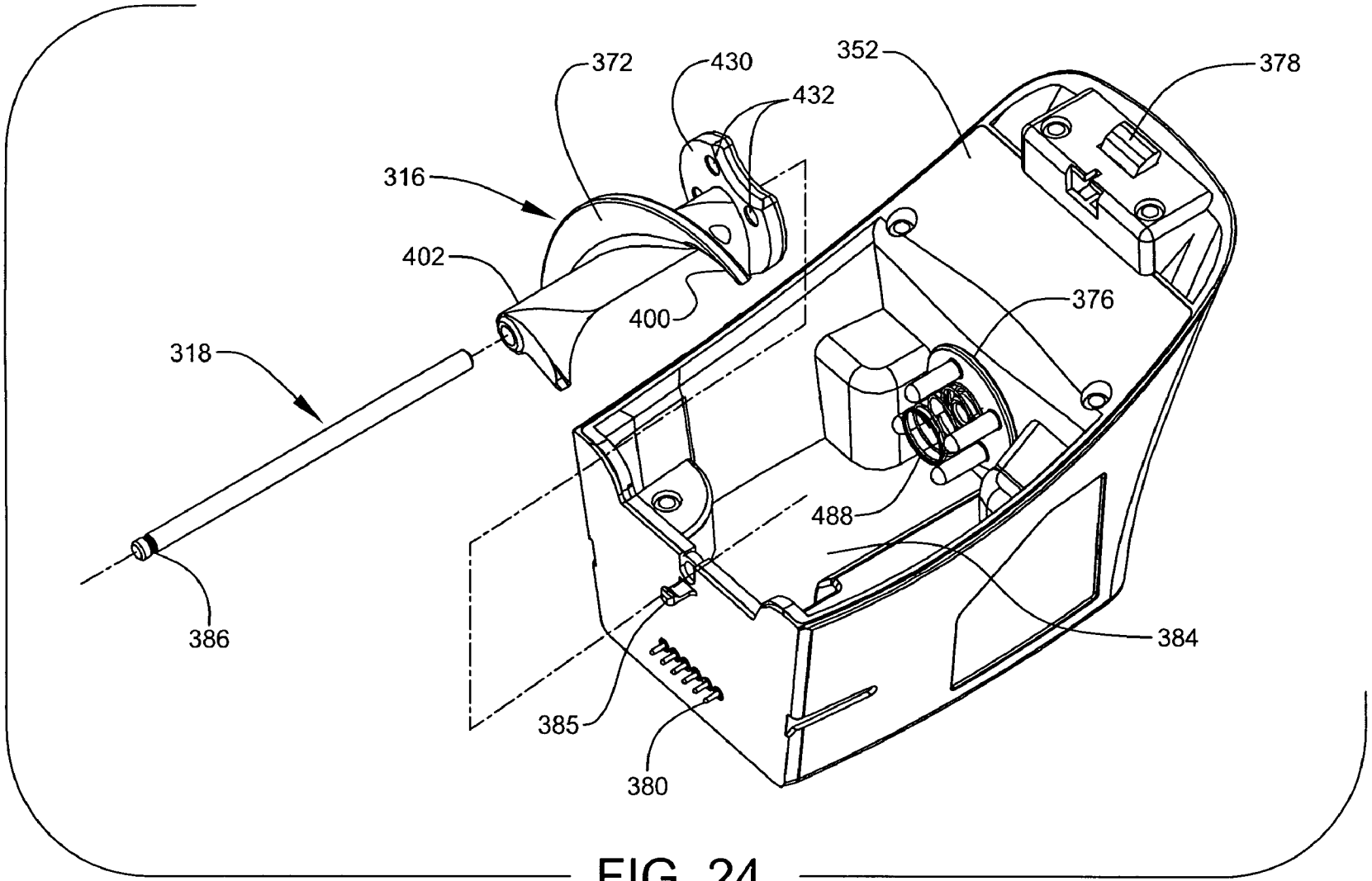
FIG. 24 shows an exploded view of the removable auger tray according to the preferred embodiment of FIG. 15.

FIG. 24 shows an exploded view of the removable auger drive tray 314 according to the preferred embodiment of FIG.

15. Cleaning of the individual drive components of auger drive tray 314 is facilitated by the ability to remove auger 316 from auger drive tray 314, as shown. Preferably, auger 316 is removed by pulling auger support shaft 318 allowing auger 316 to be lifted from the tray, as shown. Preferably, both the debris tray 384 and auger 316 can then be wiped down with a cloth.

Preferably, auger support shaft 318 is retained within a auger drive tray 314 by a projecting tab 385 adapted to engage a circumferential slot 386 formed within the end of auger support shaft 318, as shown. Thus, disassembly and assembly is undemanding and may preferably be accomplished without the use of tools (in the least embodying herein at least one removable tray assembly structured and arranged to be removable from at least one paintball storage compartment without the use of tools; wherein said at least one removable tray at least comprises said at least one rotatable auger and said at least one catch tray; and wherein said at least one rotatable auger is removable from said at least one removable tray assembly to assist cleaning of said at least one catch tray; and said at least one rotatable auger is removable from said at least one removable tray assembly without tools).

Figures 25, 26:
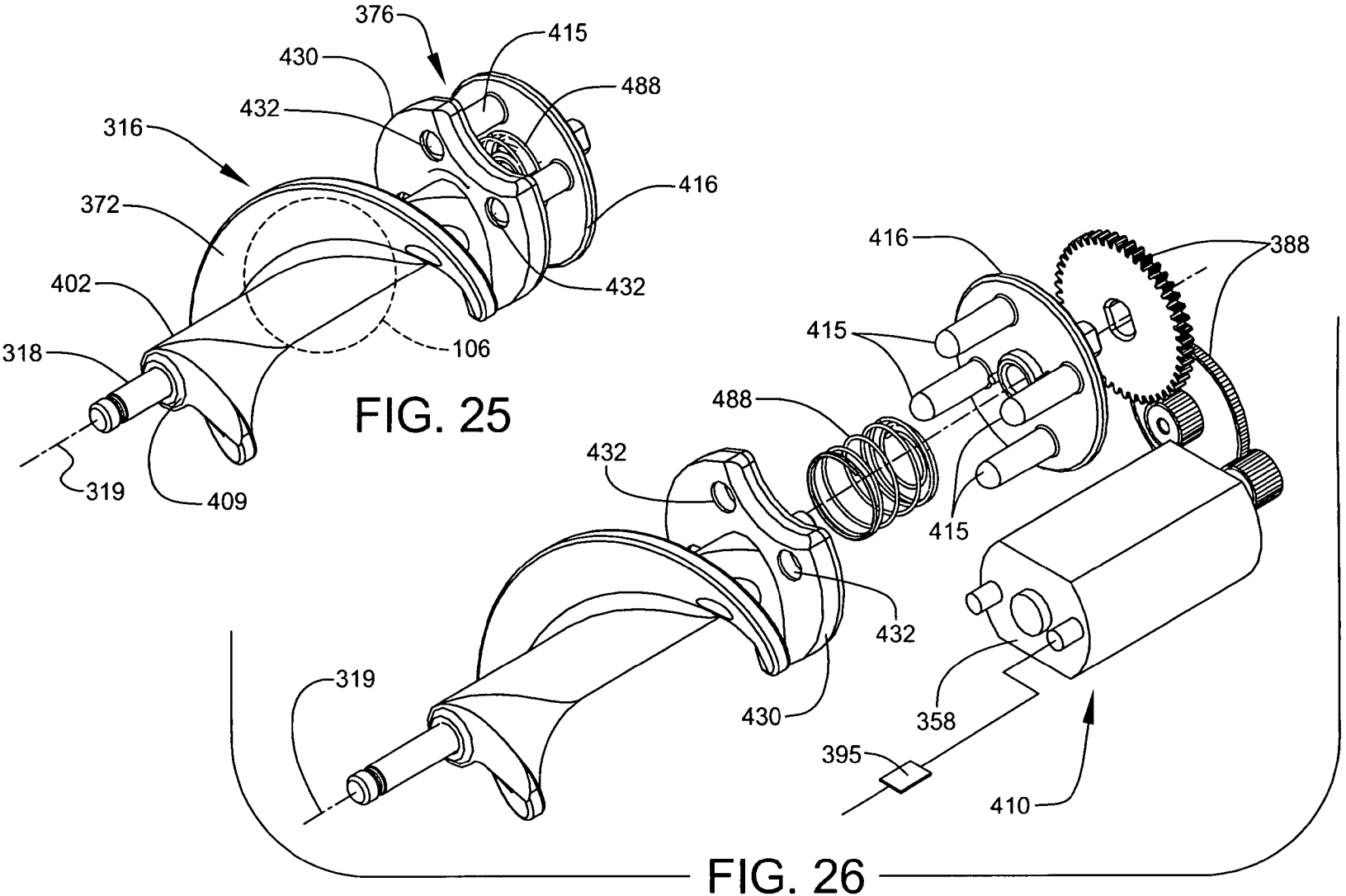
FIG. 25 shows a perspective view of an alternate auger drive assembly according to the preferred embodiment of FIG. 15.
FIG. 26 shows an exploded view of the alternate auger drive assembly, including an associated rotator assembly, according to the preferred embodiment of FIG. 15.

FIG. 25 shows a perspective view of auger drive assembly 408 according to the preferred embodiment of FIG. 15. FIG. 26 shows an exploded view of auger drive assembly 408, including rotator assembly 410, according to the preferred embodiment of FIG. 15. Preferably, auger drive assembly 408 comprises auger 316, auger support shaft 318, power coupler 376, and bias spring 488, as shown.

Preferably, auger 316 comprises at least one resilient material, preferably, at least one elastomer to resiliently engage paintball 106 during the exerting of a moving force on paintball 106 by auger 316. The moving force exerted on the paintballs by auger 316 is at least partially settable to a maximum limit through the selection of the resilient material. More specifically, by selecting a specific material hardness or softness (shore durometer rating) force loads exerted on the paintball supplied to the auger may be better controlled.

Preferably, the selected elastomer is co-molded to an interior sleeve 409 comprising a rigid friction-reducing member extending substantially along the length of auger 316. Preferably, proximal auger end-region 400 of auger 316 comprises end flange 430, as shown. Preferably, end flange 430 comprises a rigid disk preferably co-molded with auger 316, as shown.

It is again preferred that power coupler comprises a means for facilitating axial auger movement while maintaining the ability to transfer rotational torque between rotator assembly 410 and auger 316. Preferably, auger 316 is free to move axially along auger support shaft 318 (coaxial with auger axis of rotation 319) between at least one first position 422 (illustrated in FIG. 27), and at least one second position 424 (illustrated in FIG. 28). Power coupler 376 is preferably adapted to transfer rotational power between rotator assembly 410 and auger 316 while enabling the above-described axial movement of auger 316 along auger support shaft 318 (the above-described mounting of auger 316 at least embodying herein at least one axial translator).

Preferably, power coupler 376 comprises at least one projecting transfer member, more preferably, at least four projecting transfer members 415, as shown. Preferably, a disk-shaped support member 416 preferably supports each projecting transfer member 415 in a position substantially parallel with auger axis of rotation 319, as shown.

Preferably, support member 416 is operably coupled with rotator assembly 410, as shown. Preferably, rotator assembly 410 comprises an electrically-driven motor 358 driving a set of reduction gears 388, as shown. Preferably, operation of motor rotates support member 416, along with the projecting transfer members 415, about auger axis of rotation 319.

Preferably, end flange 430 comprises apertures 432 structured and arranged to slidably engage projecting transfer members 415, as shown in FIG. 25. Thus, when auger is engaged as shown, rotation of projecting transfer members 415 produces an equivalent rotation of auger 316.

Figure 29:
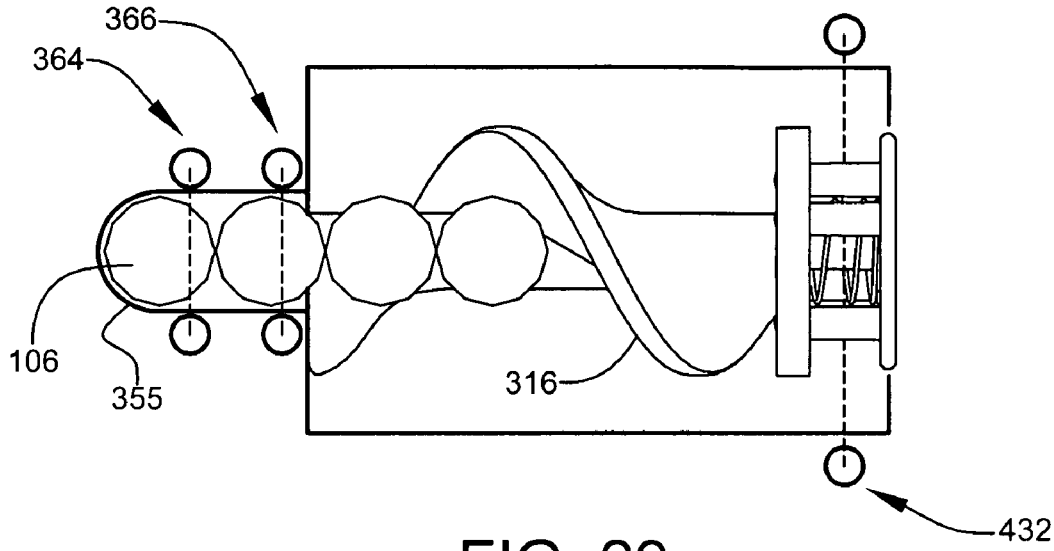
FIG. 29 shows a top view schematic diagram illustrating preferred positioning of sensors within is with the alternate paintball loader of FIG. 15.

Preferably, rotation of auger 316 exerts at least one force (at least embodying herein at least one second force) on at least one up-stream paintball of the single file alignment of paintballs 106 extending through internal feed-tube sleeve 355 to the breach of the paintball gun (see the diagram of FIG. 29). Preferably, such auger-applied force is structured and arranged to convey the paintballs generally toward internal feed-tube sleeve 355 and the gun.

Preferably, auger drive assembly 408 further comprises at least one positional biaser, comprising at least one biasing force, structured and arranged to positionally bias auger 316 toward first position first position 422. Preferably, auger 316 is positionally biased toward first position 422 by bias spring 488, as shown. Preferably, bias spring 488, most preferably at least one helical spring, is situate coaxially with auger axis of rotation 319, generally between end flange 430 and the forward face of support member 416, as shown.

Again, it is highly preferred that a minimal level of force be maintained on the queued stack of paintballs 106 at all times. Preferably, this application of force should be applied continuously, even while the user is not firing. Preferably, bias spring 488 also functions to maintain continuous pressure on the ball stack, even when auger 316 is not spinning. This preferred "constant biasing force" assures that a paintball 106 is driven into the breech the moment the bolt of paintball gun 104 is opened sufficiently to pass the paintball, even before electrically-driven motor 150 is activated. The preferred design comprises a true force-feed arrangement such that when auger 316 is not rotating to provide the primary moving force (at least in body and herein at least one second force), the bias spring 488 continues to "prime" the paintball stack by maintaining a biasing force on at least one upstream paintball of the stack, thus urging the entire stack toward the breach of the gun.

The preferred use of the helical spring greatly reduces the electrical power requirements of the system, as the electrically-driven motor is not required to be the source of the biasing force. Thus, the life of the onboard batteries 146 are extended during operation.

The use of an auger to drive paintballs 106 is highly efficient in terms of weight when compared to other types of rotating systems. Furthermore, the preferred axial pre-loading arrangement of alternate paintball loader 302 is superior in that auger drive assembly 408 is substantially isolated from the action of biasing force. This greatly reduces wear on the drive components (e.g., gearing, bearing surfaces, motor shafts, etc.), that would otherwise occur if such a biasing arrangement were to be directly integrated within the motorized drive train. In addition, the preferred combination of a resilient auger 316 and the above-described axial pre-loading is superior in controlling the level of force applied to the surface of the paintballs.

Figure 27:
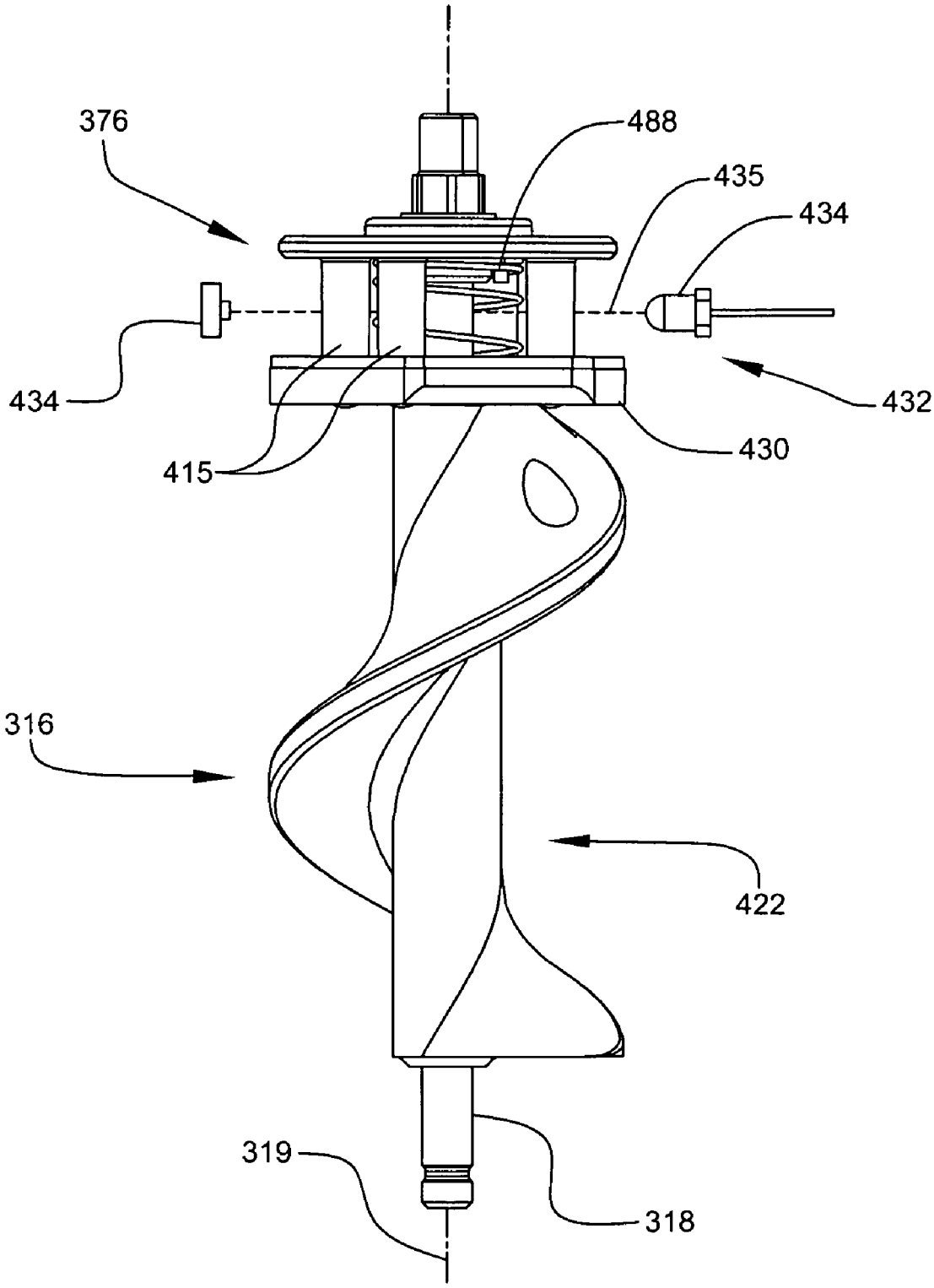
FIG. 27 shows a top view of the alternate auger drive assembly, in a first operable position, according to the preferred embodiment of FIG. 15.
Figure 28:
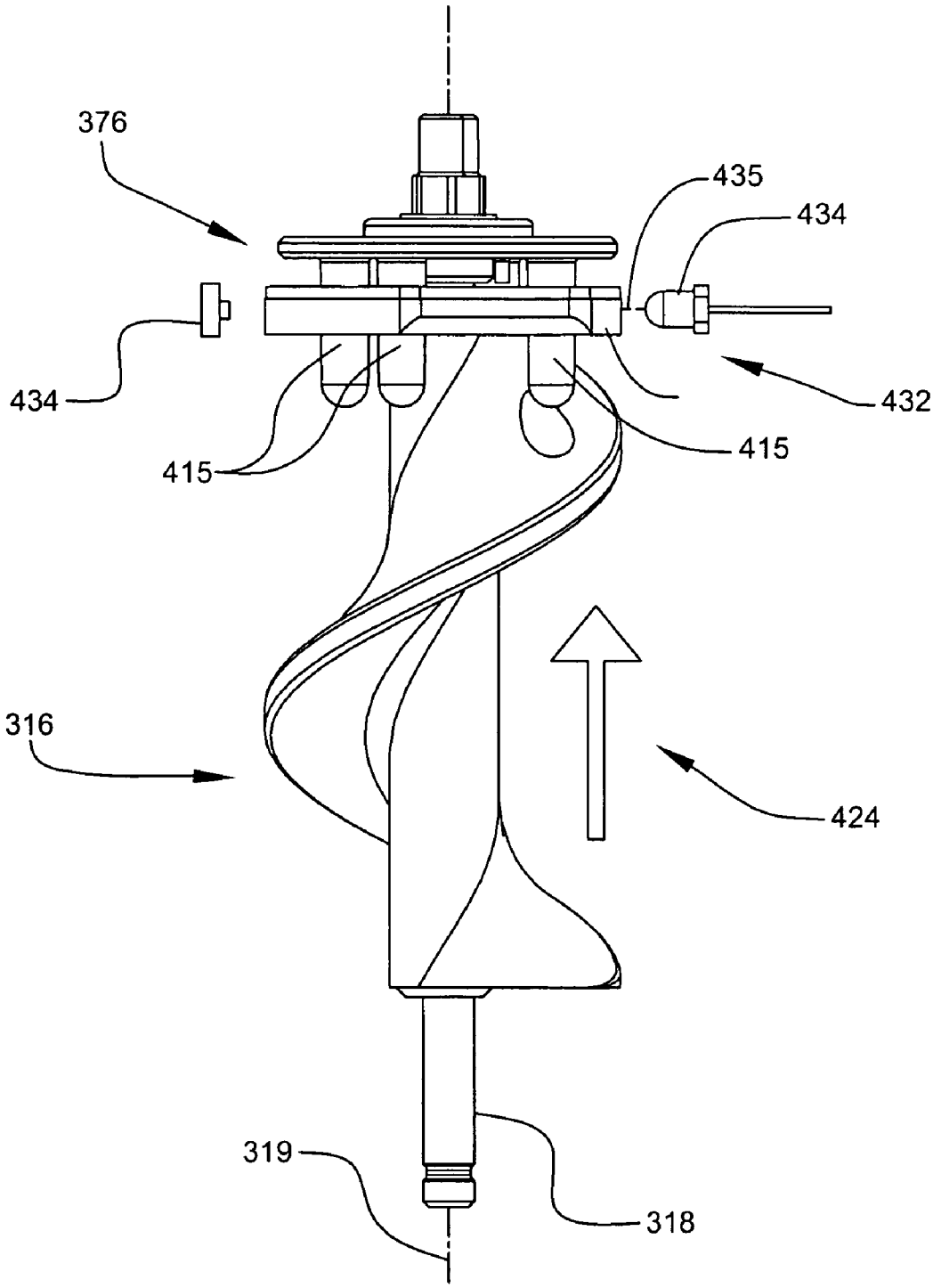
FIG. 28 shows a second top view of the alternate auger drive assembly, in a second operable position, according to the preferred embodiment of FIG. 15.

FIG. 27 shows a top view of auger drive assembly 408 in first position 422. FIG. 28 shows a second top view of auger drive assembly 408 in second position 424 according to the preferred embodiment of FIG. 15. FIG. 29 shows a top view schematic diagram illustrating preferred positioning of sensors within the alternate paintball loader 302. FIG. 30 shows a diagrammatic side view of preferred sensor positioning within alternate paintball loader 302.

As previously described, two pairs of IR sensors measure the speed at which balls are passing through internal feed-tube sleeve 355, and adjust the rotation of auger 316 to maximize feed rate. Preferably, a third set of sensors, identified herein as auger sensor unit 432 sits at the rear of auger 316 and monitors its movement and position. Preferably, auger sensor unit 432 comprises a matched emitter/receiver pair 434 that is preferably mounted to main electronics board 392 and is preferably positioned adjacent power coupler 376, as shown.

Preferably, the emitter of the emitter/detector pair generates beam 435 that projects through power coupler 376 to the corresponding detector. Preferably, auger sensor unit 432 comprises an infrared (IR) emitter/detector pair preferably utilizing an infrared beam. Preferably, auger sensor unit 432 is electrically coupled with the control circuits of main electronics board 392. Upon reading the teachings of this specification, those of ordinary skill in the art will now understand that, under appropriate circumstances, considering such issues as intended use, etc., other sensor arrangements, such as hall-effect sensors, shaft position encoder, etc., may suffice.

Referring to FIG. 27 illustrating auger 316 in first position 422, during rotation of the projecting transfer members 415, beam 435 is momentarily interrupted, resulting in a change of detector output voltage that is preferably registered at main electronics board 392. Preferably, the patterns of voltage changes within the detection units allow the microcontroller to determine rate of rotation of auger 316. Preferably, auger-rotation data is used to adjust and optimize the rotation of auger 316, as further described below.

Preferably, axial translation of auger 316 is initiated by a buildup of pressure within the ball stack leading to paintball gun 104. As noted previously, this buildup in pressure is expected when paintball gun 104 is idled, the bolt is closed, and auger 316 is rotating under the power of rotator assembly 410. Alternately, a buildup in pressure is expected when auger 316 is rotating and a jam has occurred within the ball path. Preferably, a sufficient buildup in pressure results in the urging of auger 316 axially rearward to second position 424, as illustrated in FIG. 28.

Referring to FIG. 28 illustrating auger 316 in second position 424, the presence of auger 316 in second position 424 continuously interrupts beam 435, resulting in a steady change in detector output voltage, which is preferably registered at main electronics board 392. Preferably, this steady voltage output from auger sensor unit 432 allows the microcontroller to determine axial position of auger 316. Such auger-position data is preferably used to appropriately adjust the rotation of auger 316, as further described below. It is further noted that, under the preferred design, a condition may occur where the infrared beam is continuously blocked by one or more projecting transfer members 415 while auger 316 is in first position 422 and rotationally stopped. To disambiguate the positional status of auger 316, the control system is designed to initiate a small rotation of auger 316 to reposition projecting transfer members 415 away from beam 435. If the status of auger sensor unit 432 remains substantially unchanged, the control system assigns the second position 424 to auger 316. If the output signal of auger sensor unit 432 changes, the control system determines that auger 316 is in the stopped and in first position 422.

Preferably, control of the operation of paintball loader 302 is provided by rotation-control subsystem 460 embodied by an embedded microcontroller unit (MCU 440) programmed to sample data from the onboard sensors, determine the optimum auger rotation, and implement such optimization using rotator assembly 410 to adjust the rotation of auger 316. Preferably, rotation-control subsystem 460 adjusts the rotational speed of auger 316 to match the rate of firing at paintball gun 104. Preferably, rotation-control subsystem 460 automatically adjusts auger rotation to an optimum feed rate, without user intervention. Furthermore, rotation-control subsystem 460 automatically detects and clears paintball jams within the feed path.

Preferably, the rotational control of auger 316 is implemented by electrical control of the electrically-driven motor 358. Preferably, rotation-control subsystem 460 is adapted to control the conduction of electrical power between batteries 147 and motor 358. As is typical in direct current (DC) motors, the speed of motor 358 is generally proportional to the supply voltage. Preferably, rotation-control subsystem 460 is adapted to control the rotational direction and rotational speed of auger 316 by adjusting the supply voltage to motor 358. Preferably, voltage adjustment by rotation-control subsystem 460 is implemented by adapting voltage-control circuits known in the art of small motor control. A preferred embodiment of rotation-control subsystem 460 comprises a pulse width modulator using of one or more power MOSFETs under the control of MCU 440. Upon reading the teachings of this specification, those of ordinary skill in the art will now understand that, under appropriate circumstances, considering such issues as user preference, intended use, etc., other control arrangements, such as feedback-loop control, open-loop control, digital potentiometer control, etc., may suffice.

MCU 440 is preferably a "single-chip" microcomputer containing a central processing unit, read-only memory (ROM) or equivalent, for storing the control program, read-write memory (RAM) for storing sensor data, a counter-timer facility for accurate measurement and scheduling of loader events, and appropriate interfaces to the onboard devices of the embodiment. Preferably, an analog-to-digital (A-D) converter receives analog data from the onboard sensors (as applicable) and converts these signals into digital data suitable for use by the MCU 440. Preferably, circuitry supporting analog-to-digital (A-D) converter (e.g., voltage references, etc.) is also provided. MCU 440 is preferably located on main electronics board 392, as shown. Preferably, rotation-control subsystem 460 comprises non-volatile memory for non-volatile storage of the control software and other important variable data. The non-volatile memory preferably retains the information stored in it even when power is removed from the device. This preferred feature is enabled by the implementation of at least one nonvolatile memory device, which preferably includes such technology as Electrically-Erasable Programmable Read-Only Memory (EEPROM) modules or alternately preferably similar FLASH-based variants. Upon reading the teachings of this specification, those of ordinary skill in the art will now understand that, under appropriate circumstances, considering such issues as intended use, etc., other arrangements, such as battery backup circuits, nonvolatile random access memory (RAM) chips, etc., may suffice.

Preferably, MCU 440 is operationally coupled to user interface electronics board 394. Preferably, user interface electronics board 394 comprises both user controls and visual indicators. More specifically, user interface electronics board 394 comprises green display indicator 470A, red display indicator 470B, and on/off switch 471, as best shown in FIG. 18.

Preferably, operational power for both rotation-control subsystem 460 and rotator assembly 410 is provided by batteries 147. Preferably, alternate paintball loader 302 operates on four AA batteries, or alternately preferably, on two lithium ion camcorder batteries. Preferred Lithium ion camcorder batteries include KLIC 8000 digital camera batteries produced by the Kodak Corporation. Lithium Ion batteries are generally preferred for their inherent lightweight and superior energy density. In addition, lithium-ion batteries are rechargeable.

FIG. 31 is a table indicating preferred operation relationships between the reporting of sensors and control of ball delivery within alternate paintball loader 302. Preferably, the control software of rotation-control subsystem 460 is adapted to adjust the rotational speed of the auger to the rate of firing at the gun. In addition, the control software of rotation-control subsystem 460 is preferably adapted to detect and clear paintball jams occurring within the feed path. Preferably, rotation-control subsystem 460 is able to distinguish between normal "stacking" of paintballs during a non-firing condition, and a restriction to the rotation of auger 316 due to a jam condition. Preferably, rotation-control subsystem 460 is structured and arranged to automatically adjust the rotation of auger 316 to clear such jams.

Preferably, the control software of rotation-control subsystem 460 is adapted to utilize sensor data from first detection unit 364, second detection unit 366, and auger sensor unit 432 to determine the optimum rotation of auger 316. Table A of FIG. 31 is a relational matrix of sensor inputs, preferred controller actions, and preferred visual indications during various states of operation.

In first operational state 501, a flow is detected by first detection unit 364, no flow is detected by second detection unit 366, and auger sensor unit 432 indicates that auger 316 is in second position 424. Rotation-control subsystem 460 is preferably programmed to associate first operational state 501 with a ball jam within the feed path, as shown. In response to first operational state 501, rotation-control subsystem 460 initiates a single reverse revolution of auger 316 (to clear the paintball jam) and then preferably rotates auger 316 forward. Preferably, both green display indicator 470A and red display indicator 470B are illuminated in a flashing pattern to indicate to the user that a jam condition has occurred.

In second operational state 502, a flow is detected by first detection unit 364, no flow is detected by second detection unit 366, and auger sensor unit 432 indicates that auger 316 is rotating. Rotation-control subsystem 460 is preferably programmed to associate second operational state 502 with a "no ball" condition, as shown. This condition may occur when the paintballs within paintball storage compartment 310 have been expended. In response to second operational state 502, rotation-control subsystem 460 adjusts rotation of auger 316 alternately between a slow rotation speed and a medium rotation speed, as shown. Preferably, green display indicator 470A is illuminated in a flashing pattern to indicate to the user that paintball storage compartment 310 may be empty.

In third operational state 503, a flow is detected by first detection unit 364, a flow is detected by second detection unit 366, and auger sensor unit 432 indicates that auger 316 is rotating. Rotation-control subsystem 460 is preferably programmed to associate third operational state 503 with a "normal run" condition, as shown. In response to third operational state 503, rotation-control subsystem 460 adjusts rotation of auger 316 to full rotational speed, as shown. Preferably, green display indicator 470A is constantly illuminated to indicate to the user that operation of alternate paintball loader 302 is normal.

In fourth operational state 504, no flow is detected by first detection unit 364, no flow is detected by second detection unit 366, and auger sensor unit 432 indicates that auger 316 is in second position 424. Rotation-control subsystem 460 is preferably programmed to associate fourth operational state 504 with a "stack full" condition, as shown. A "stack full" condition occurs when paintball gun 104 is idled, the bolt is closed, and rotation of auger 316 against stack has urged auger 316 to second position 424. In response to fourth operational state 504, rotation-control subsystem 460 preferably stops rotation of auger 316 and occasionally "pulses" auger 316 using brief partial rotations, as shown. Preferably, green display indicator 470A is constantly illuminated to indicate to the user that operation of alternate paintball loader 302 is normal. The above-described preferred operation of rotation-control subsystem 460 greatly extends battery life by efficiently managing the use of motor 358, preferably deactivating motor 358 completely when paintball gun 104 is not firing.

In fifth operational state 505, no flow is detected by first detection unit 364, no flow is detected by second detection unit 366, and auger sensor unit 432 indicates that auger 316 is rotating. Rotation-control subsystem 460 is preferably programmed to associate fifth operational state 505 with a "no ball" condition, as shown. This condition may occur when the paintballs within paintball storage compartment 310 have been expended. In response to second operational state 502, rotation-control subsystem 460 adjusts rotation of auger 316 alternately between a slow rotation speed and a medium rotation speed, as shown. Preferably, green display indicator 470A is illuminated in a flashing pattern to indicate to the user that paintball storage compartment 310 is empty.

Thus, as illustrated above, rotation-control subsystem 460 is preferably programmed to automatically optimize the operation of alternate paintball loader 302 by quickly adjusting the rotation of auger 316, based on monitored sensor data. The preferred low mass of auger 316 allows motor 358 to quickly ramp-up to a selected rotation speed. The preferred use of three separate sensors (preferably monitoring ball flow, auger rotation, and auger position) allows rotation-control subsystem 460 to exhibit highly responsive operation characteristics, preferably adjusting the rotation of auger 316 to allow high-speed feeding with relatively low levels of force applied to the paintballs.

Figure 32:
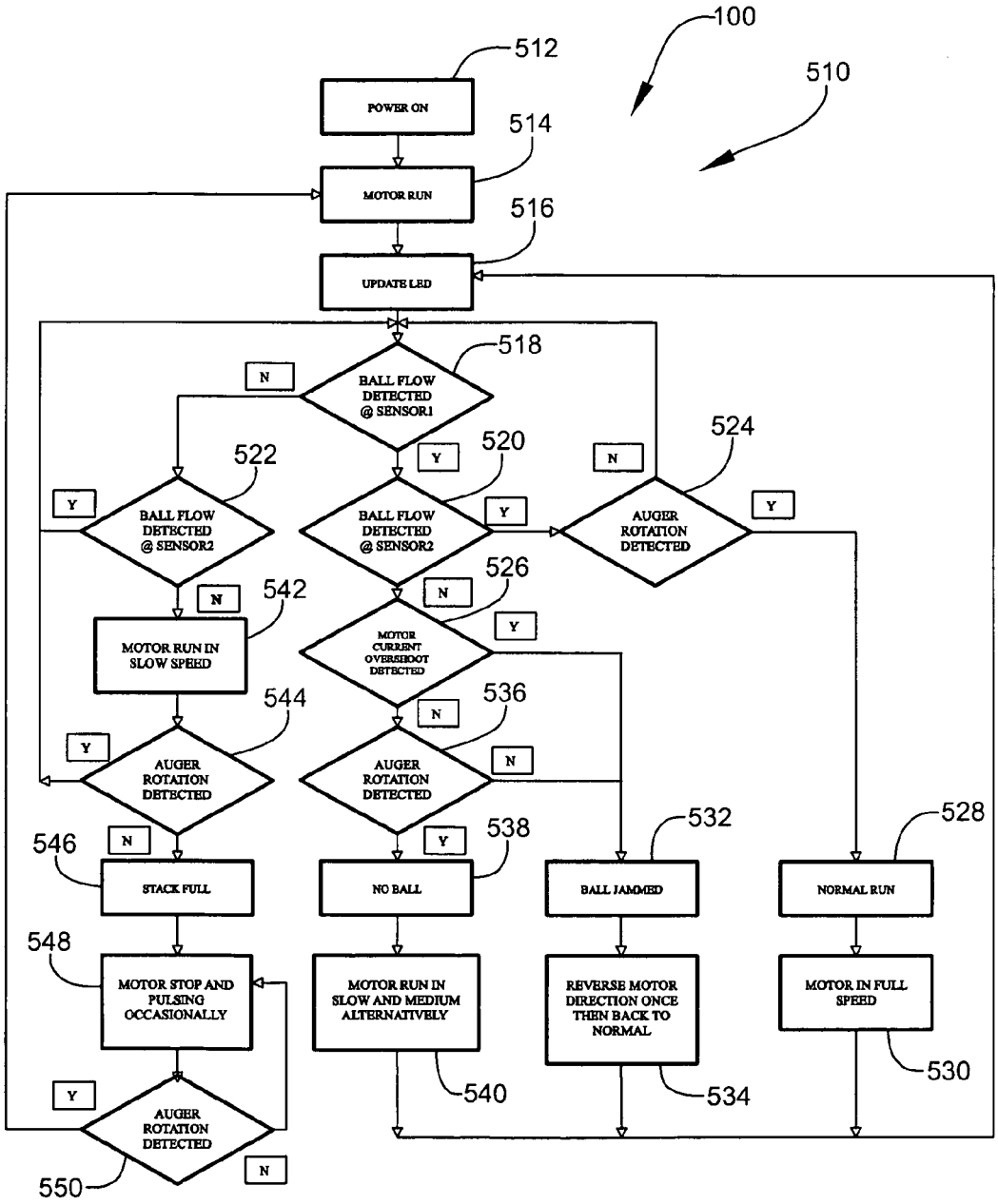
FIG. 32 is a flow diagram indicating preferred software control within the alternate paintball loader of FIG. 15.

FIG. 32 is a flow diagram indicating the preferred functioning control software 510 enabling the operation of MCU 440 and rotation-control subsystem 460 of alternate paintball loader 302. In general, control software 510 is adapted to control the physical hardware of alternate paintball loader 302 by executing algorithms controlling predefined bit/register processes within the internal I/O ports of MCU 440, thus controlling the voltages at the I/O pins.

Preferably, control software 510, operating within MCU 440, processes a plurality of inputs, including, user inputs (the closing of on/off switch 471) within user interface electronics board 394, sensor inputs (first detection unit 364, second detection unit 366, and auger sensor unit 432).

Preferably, control software 510, operating within MCU 440, comprises algorithms adapted to generate a plurality of outputs, as a function of the above-described inputs and several other process factors, such as, for example, elapsed time, reference voltage, etc. Preferably, such outputs include the illumination of display indicators 470 within user interface electronics board 394, and outputs changing the operation of physical components directly related to fire control (rotator assembly 410).

Programming of MCU 440 to function as desired requires several steps. First control software 510 is coded to comprise the logical processes presented in the following flowchart.

Next, the coded control software 510 is compiled. Finally, the compiled version of control software 510 is transferred into MCU 440.

FIG. 32 is a simplified flow diagram illustrating the preferred sequence of programmed steps coded within control software 510. Preferably, the first step executed within control software 510 is the registering of a power-on signal from on/off switch 471, as indicated in preferred step 512.

Next, motor 358 is energized as indicated in preferred step 514. Next, display indicators 470, preferably comprising light emitting diodes (LED) are updated as indicated in preferred step 516.

The above-describes steps preferably function to initiate the operation of alternate paintball loader 302. From a user's standpoint, operation of alternate paintball loader 302 is initiated by depressing on/off switch 471 until the green display indicator 470A illuminates to indicate that the loader is operational. There is no need for the user to adjust any other operational settings as the preferred control arrangements enabled within rotation-control subsystem 460 automatically control the subsequent operation of alternate paintball loader 302, as further described below.

Next, decision step 518 is preferably executed within control software 510. In decision step 518, control software 510 determines the status of first detection unit 364. If a ball flow is detected, control software 510 enters preferred decision step 520. If a ball flow is not detected, control software 510 enters preferred decision step 522, as shown.

In decision step 520, control software 510 determines the status of second detection unit 366. If a ball flow is detected, control software 510 enters preferred decision step 524. If a ball flow is not detected, control software 510 enters preferred decision step 526, as shown.

In decision step 524, control software 510 determines the status of auger sensor unit 432. If an auger rotation is detected, control software 510 enters normal run step 528 and enables the full-speed operation of motor 358, as indicated in preferred step 530. Preferably, on completion of preferred step 530, control software 510 immediately loops back to preferred step 516.

In reference to preferred decision step 524, if an auger rotation is not detected, control software 510 immediately loops back to preferred step 516.

In reference to preferred decision step 526, control software 510 preferably determines if the current draw by motor 358 exceeds a predetermined limit. Excess current draw by motor 358 is indicative of a full ball stack or the presence of a ball jam. This condition is preferably disambiguated by comparing additional sensor data. Preferably, the circuiting of main electronics board 392 is structured and arranged to sense current draw by motor 358, preferably utilizing a current monitoring sensor 395, as shown.

If the current draw by motor 358 exceeds a predetermined limit, control software 510 enters "ball jammed" step 532 and initiates a single reverse revolution of auger 316 (to clear the paintball jam) and then preferably rotates auger 316 forward, as indicated in preferred step 534. Preferably, on completion of preferred step 534, control software 510 immediately loops back to preferred step 516.

If the current draw by motor 358 does not exceed the predetermined limit, software 510 enters preferred decision step 536 wherein the status of auger rotation determined. In decision step 536, control software 510 determines the status of auger sensor unit 432. If an auger rotation is not detected, control software 510 enters "ball jammed" step 532, as shown.

If an auger rotation is detected in decision step 536, control software 510 enters "no ball" step 538 and motor 358 is operated to rotate auger 316 alternately between a slow and medium rotational speed, as indicated in preferred step 540. Preferably, on completion of preferred step 534, control software 510 immediately loops back to preferred step 516.

In reference to preferred decision step 522, control software 510 preferably determines the status of second detection unit 366. If a ball flow is detected, control software 510 immediately returns to preferred decision step 518, as shown.

If in preferred decision step 522, a ball flow is not detected, control software 510 preferably adjusts the rotation rate of motor 358 to a slow speed, as indicated in preferred step 542, and immediately enters preferred decision step 544, as shown. In decision step 544, control software 510 determines the status of auger sensor unit 432. If an auger rotation is detected, control software 510 immediately returns to preferred decision step 518, as shown. If in decision step 544 an auger rotation is not detected, control software 510 enters "stack full" step 546 and stops the operation of motor 358, as indicated in preferred step 350. Within preferred step 548, control software 510 is further structured and arranged to initiate an occasional pulsing of motor 358, preferably resulting in a small rotation of auger 316. Preferably, on completion of preferred step 548, control software 510 enters preferred decision step 550, as shown.

In decision step 550, control software 510 again determines the status of auger sensor unit 432. If an auger rotation is detected, control software 510 immediately returns to preferred step 514, as shown. If in decision step 550 an auger rotation is not detected, control software 510 immediately loops to preferred step 548 wherein operation of motor 358 is stopped with the exception of the above-noted occasional pulsing.

Upon reading the teachings of this specification, those of ordinary skill in the art will now understand that, under appropriate circumstances, considering such issues as intended use, user preference, advances in technology, etc., other hardware/software arrangements, such as the monitoring of additional sensor points within the loader, logging of feed data, wireless reporting of loader telemetry with a remote entity, utilizing wireless interfaces to update software, utilizing I/O ports to update software/implement system diagnostics, expanding programming to include additional user control, utilizing removable storage media to enable program updating, etc., may suffice.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A paintball loader system comprising:

a) at least one paintball storage compartment to store paintballs;

b) mounted within said at least one paintball storage compartment, at least one rotatable auger structured and arranged to convey paintballs from said at least one paintball storage compartment to at least one ball passage leading to at least one paintball gun; and c) at least one rotator structured and arranged to rotate said at least one rotatable auger;

d) wherein said at least one rotatable auger comprises at least one axial translator structured and arranged to assist axial translation of said at least one rotatable auger along at least one axis of rotation between at least one first auger position and at least one second auger position;

e) wherein said at least one axial translator comprises at least one positional biaser, comprising at least one biasing force, structured and arranged to positionally bias said at least one rotatable auger toward said at least one first position; and f) wherein such at least one biasing force is structured and arranged to urge at least one first paintball toward the at least one paintball gun.

2. The paintball loader system according to claim 1 further comprising:

a) such at least one ball passage structured and arranged to pass paintballs between said at least one paintball storage compartment and the at least one paintball gun in substantially single-file alignment;

b) wherein rotation of said at least one rotatable auger is structured and arranged to exert at least one second force on the at least one first paintball, comprising at least one up-stream paintball of the single file alignment, during such rotation; and c) wherein such at least one second force is structured and arranged to convey the at least one first paintball generally toward said at least one ball passage.

3. The paintball loader system according to claim 2 wherein:

a) said at least one rotatable auger is structured and arranged to be urged toward said at least one second position in response to the development of at least one resistance force, acting between the at least one first paintball and said at least one rotatable auger; and b) wherein at least one substantially constant force, comprising at least one of such at least one biasing force and such at least one second force, is structured and arranged to substantially constantly urge the at least one first paintball, comprising at least one up-stream paintball of such substantially single-file alignment, toward the at least one paintball gun.

4. The paintball loader system according to claim 3 further comprising:

a) at least one rotation controller structured and arranged to control the rotation of said at least one rotatable auger;

b) operationally coupled with said at least one rotation controller, at least one positional sensor structured and arranged to sense the position said at least one rotatable auger;

c) wherein said at least one rotational controller is structured and arranged to adjust the rotation of said at least one rotatable auger in response to at least one positional condition of said at least one rotatable auger substantially comprising the presence of said at least one rotatable auger in said at least one first position or said at least one second position.

5. The paintball loader system according to claim 4 wherein such at least one adjustment to the rotation of said at least one rotatable auger comprises at least one stop of rotation.

6. The paintball loader system according to claim 5 wherein said at least one rotator comprises:

a) at least one electric motor structured and arranged to provide at least one rotational force;

b) at least one force-transfer assembly structured and arranged to transfer the at least one rotational force generated by said at least one electric motor to said at least one rotatable auger;

c) at least one electric power source structured and arranged to provide electric power usable by said at least one electric motor; and d) at least one electrical coupler structured and arranged to couple said at least one electric power source to said at least one electric motor;

e) wherein conduction of the electric power by said at least one electrical coupler is controlled by said at least one rotational controller.

7. The paintball loader system according to claim 6 wherein said at least one rotational controller comprises:

a) at least one position detector structured and arranged to detect the presence of said at least one rotatable auger in said at least one second position;

b) wherein said at least one rotational controller is further structured and arranged to alter the delivery of the electric power through said at least one electrical coupler when said at least one position detector detects the presence of said at least one rotatable auger in said at least one second position.

8. The paintball loader system according to claim 7 wherein said at least one force-transfer assembly comprises:

a) at least one projecting transfer member structured and arranged to transfer at least one force;

b) at least one support member structured and arranged to support said at least one projecting transfer member in at least one position substantially parallel with such at least one axis of rotation;

c) wherein said at least one support member is operably coupled with said at least one electric motor;

d) wherein said at least one support member and said at least one projecting transfer member are structured and arranged to rotate about the at least one axis of rotation during operation of at least one electric motor;

e) wherein said at least one rotatable auger comprises at least one aperture structured and arranged to slidably engage said at least one projecting transfer member; and f) wherein, when said at least one rotatable auger is slidably engaged thereon, rotation of said projecting transfer member produces the rotation of said at least one rotatable auger.

9. The paintball loader system according to claim 8 wherein said at least one positional biaser comprises at least one helical spring acting between said at least one support member and said at least one end flange.

10. The paintball loader system according to claim 8 wherein:

a) said at least one end flange comprises at least one projecting tab;

b) said at least one lash cage comprises at least one longitudinal slot structured and arranged to movably receive said at least one projecting tab;

c) said at least one longitudinal slot comprises at least one longitudinal slot-length at least greater than at least one longitudinal tab-thickness of said at least one projecting tab; and d) said at least one longitudinal slot comprises at least one transverse slot-width substantially equal to at least one transverse tab-width of said at least one projecting tab.

11. The paintball loader system according to claim 8 wherein said at least one paintball storage compartment further comprises:

a) at least one first guide-wall structured and arranged to guide the paintballs toward at least one first side of said at least one rotatable auger;

b) at least one second guide-wall structured and arranged to guide the paintballs toward at least one second side of said at least one rotatable auger;

c) at least one catch tray structured and arranged to catch debris occurring within said at least one paintball storage compartment during use;

d) at least one debris passage structured and arranged to i) pass such ball-associated debris from said at least one paintball storage compartment to said at least one catch tray, and ii) restrict passage of the paintballs from said at least one paintball storage compartment to said at least one catch tray;

e) wherein said at least one debris passage is located within at least one of said at least one first guide-wall and said at least one second guide-wall; and f) wherein said at least one catch tray is located gravitationally below said at least one rotatable auger.

12. The paintball loader system according to claim 8 wherein said at least one rotatable auger substantially comprises at least one resilient material structured and arranged to resiliently engage the at least one first paintball.

13. The paintball loader system according to claim 8 wherein said at least one ball passage comprises:

a) at least one hollow cylindrical channel structured and arranged to channel the paintballs to the at least one paintball gun in such substantially single-file alignment;

b) wherein said at least one hollow cylindrical channel comprises i) located proximally of said at least one paintball storage compartment, at least one paintball entry portion, and ii) located downstream of said at least one paintball entry portion, at least one paintball exit portion, c) wherein said at least one paintball exit portion comprises at least one first flow detector structured and arranged to detect at least one first paintball flow condition within said at least one paintball exit portion, and d) wherein said at least one paintball entry portion comprises at least one second flow detector structured and arranged to detect a second paintball flow condition within said at least one ball entry portion;

e) wherein said at least one first flow detector and said at least one second flow detector are structured and arranged to report such first paintball flow condition and such second paintball flow condition to said at least one rotational controller; and f) wherein said at least one rotational controller is structured and arranged adjust at least one rotation characteristic of said at least one rotatable auger in response to such at least one of such first paintball flow condition and second paintball flow condition.

14. The paintball loader system according to claim 13 wherein said at least one rotational controller is structured and arranged adjust at least one rotation characteristic of said at least one rotatable auger in response to such at least one of such first paintball flow condition and such second paintball flow condition.

15. The paintball loader system according to claim 13 wherein said at least one rotational controller is structured and arranged adjust at least one rotation characteristic of said at least one rotatable auger in response to such at least one of such first paintball flow condition, such second paintball flow condition, and such at least one positional condition of said at least one rotatable auger.

16. The paintball loader system according to claim 13 wherein:

a) said at least one rotational controller comprises at least one current draw sensor structured and arranged to sense at least one level of current draw by the said at least one electric motor; and b) said at least one rotational controller is structured and arranged adjust at least one rotation characteristic of said at least one rotatable auger in response to such at least one of such first paintball flow condition, such second paintball flow condition, such at least one positional condition of said at least one rotatable auger, and such at least one level of current draw by the said at least one electric motor.

17. The paintball loader system according to claim 16 wherein said at least one rotation characteristic comprises an adjustment of a rate of rotation.

18. The paintball loader system according to claim 16 wherein said at least one rotation characteristic comprises an adjustment to a direction of rotation.

19. The paintball loader system according to claim 13 wherein:

a) said at least one first flow detector and said at least one second flow detector each comprise at least one optical sensor;

b) said at least one ball passage comprises at least one optically transparent portion structured and arranged to be substantially optically transparent to said at least one optical sensor; and c) said optically transparent portion substantially isolates said at least one optical sensor from paint debris occurring within said at least one ball passage.

20. The paintball loader system according to claim 6 wherein said at least one force-transfer assembly comprises:

a) at least one end flange coupled to said at least one rotatable auger;

b) co-axial with the at least one axis of rotation, at least one lash cage structured and arranged to movably receive said at least one end flange;

c) at least one interlocker structured and arranged to interlock said at least one end flange with said at least one lash cage;

d) wherein said at least one interlocker comprises at least one axial translator structured and arranged to allow axial translation of said at least one end flange relative to said at least one lash cage; and e) wherein said at least one interlocker further comprises at least one rotational coupler structured and arranged to rotatably couple said at least one lash cage with said at least one end flange.

21. A paintball loader system comprising:

a) at least one paintball storage compartment to store paintballs;

b) at least one ball passage structured and arranged to pass the paintballs between said at least one paintball storage compartment and at least one paintball gun;

c) at least one rotating conveyor to convey the paintballs from said at least one paintball storage compartment to said at least one ball passage;

d) at least one catch tray structured and arranged to catch ball-associated debris occurring within said at least one paintball storage compartment during use; and e) at least one debris passage structured and arranged to i) pass such ball-associated debris from said at least one paintball storage compartment to said at least one catch tray, and ii) restrict passage of the paintballs from said at least one paintball storage compartment to said at least one catch tray;

f) wherein operation of said at least one rotating conveyor moves the paintballs generally toward said at least one ball passage and assists movement of such ball-related debris to said at least one catch tray; and g) wherein a reduction of paintball-related debris adjacent the paintballs during delivery to the at least one paintball gun is achieved.

22. The paintball loader system according to claim 21 wherein said at least one rotating conveyor comprises:

a) at least one mechanical power source structured and arranged to produce at least one rotational force; and b) at least one power coupler structured and arranged to couple the at least one rotational force to said at least one conveyor.

23. The paintball loader system according to claim 22 wherein said at least one conveyor comprises at least one rotatable auger.

24. The paintball loader system according to claim 23 wherein said at least one paintball storage compartment further comprises:

a) at least one first guide-wall structured and arranged to guide the paintballs toward at least one first side of said at least one rotatable auger; and b) at least one second guide-wall structured and arranged to guide the paintballs toward at least one second side of said at least one rotatable auger;

c) wherein said at least one debris passage is located within at least one of said at least one first guide-wall and said at least one second guide-wall.

25. The paintball loader system according to claim 24 wherein said at least one catch tray is located gravitationally below said at least one rotatable auger.

26. The paintball loader system according to claim 25 further comprising:

a) at least one removable tray assembly structured and arranged to be removable from at least one paintball storage compartment without the use of tools;

b) wherein said at least one removable tray assembly at least comprises said at least one rotatable auger and said at least one catch tray.

27. The system according to claim 26 wherein:

a) said at least one rotatable auger is removable from said at least one removable tray assembly to assist cleaning of said at least one catch tray; and b) said at least one rotatable auger is removable from said at least one removable tray assembly without tools.

28. The system according to claim 27 wherein said at least one rotatable auger comprises helical flighting wound about said at least one longitudinal axis of rotation;

a) wherein said helical flighting comprises at least one ball engager structured and arranged to engage at least one outer surface portion of at least one paintball; and b) wherein said at least one ball engager substantially comprises at least one resilient material structured and arranged to resiliently engage the at least one paintball during such conveyance.

29. A paintball loader system comprising:

a) at least one paintball storage compartment to store paintballs;

b) at least one ball passage structured and arranged to pass the paintballs between said at least one paintball storage compartment and at least one paintball gun; and c) at least one conveyor to convey the paintballs from said at least one paintball storage compartment to said at least one ball passage;

d) wherein said at least one conveyor comprises i) at least one ball selector structured and arranged to select the paintballs favorably positioned for delivery to said at least one ball passage, and ii) at least one ball ejector structured and arranged to eject paintballs unfavorably positioned for delivery to said at least one ball passage from said at least one conveyor;

e) wherein such paintballs favorably positioned for delivery to said at least one ball passage are passed into said at least one ball passage by said at least one conveyor;

f) wherein such paintballs unfavorably positioned for delivery to said at least one ball passage are ejected from said at least one conveyor; and g) wherein said at least one paintball storage compartment comprises at least one relocator structured and arranged to relocate the paintballs ejected from said at least one conveyor to at least one area of said at least one paintball storage compartment generally favorable to the delivery of such ejected paintballs to said at least one ball passage by said at least one conveyor.

30. The paintball loader system according to claim 29 further comprising:

a) at least one mechanical power source structured and arranged to produce mechanical power usable to operate said at least one conveyor; and b) at least one power coupler structured and arranged to couple the mechanical power to said at least one conveyor;

c) wherein said at least one conveyor comprises at least one rotatable auger rotatably mounted within said at least one paintball storage compartment;

d) wherein said at least one rotatable auger comprises i) at least one longitudinal axis of rotation, and ii) helical flighting wound about said at least one longitudinal axis of rotation;

e) wherein said helical flighting comprises at least one ball engager structured and arranged to engage at least one outer surface portion of at least one paintball;

f) wherein said at least one power coupler is structured and arranged to transfer at least one rotational force generated by said at least one mechanical power source to said at least one rotatable auger; and g) wherein rotation of said at least one rotatable auger moves the paintballs engaged within said at least one ball engager generally toward said at least one ball passage.

31. The paintball loader system according to claim 30 wherein said at least one ball engager substantially comprises at least one resilient material.

32. The paintball loader system according to claim 31 wherein said at least one paintball storage compartment comprises:

a) at least one first guide-wall structured and arranged to guide the paintballs toward at least one first side of said at least one rotatable auger; and b) at least one second guide-wall structured and arranged to guide the paintballs toward at least one second side of said at least one rotatable auger;

c) wherein said at least one relocator comprises, extending between said at least one first guide-wall and said at least one second guide-wall, at least one transverse guide wall structured and arranged to guide movement of the ejected paintballs between said at least one second side and said at least one first side; and d) wherein said at least one ball ejector comprises at least one contact interaction between the at least one paintball and said at least one transverse guide wall.

33. The paintball loader system according to claim 32 further comprising:

a) at least one catch tray structured and arranged to catch and retain debris generated within said at least one paintball storage compartment during operation; and b) at least one debris passage structured and arranged to i) pass such debris from said at least one paintball storage compartment to said at least one catch tray, and ii) restrict passage of the paintballs from said at least one paintball storage compartment to said at least one catch tray.

34. The paintball loader system according to claim 33 wherein a) said at least one debris passage is located within at least one of said at least one first guide-wall and said at least one second guide-wall; and b) said at least one catch tray is located gravitationally below said at least one rotatable auger.

35. The paintball loader system according to claim 32 wherein:

a) said at least one first guide-wall and said at least one second guide-wall together define at least one ball channel structured and arranged to channel the paintballs engaged within said at least one ball engager toward said at least one ball passage;

b) said at least one ball channel is oriented substantially parallel with said at least one longitudinal axis of rotation;

c) said at least one rotatable auger is located adjacent said at least one ball channel; and d) said at least one ball passage originates within said at least one transverse guide wall.

36. The paintball loader system according to claim 35 wherein:

a) said at least one rotatable auger comprises at least one proximal auger end- region and at least one distal auger end-region;

b) said at least one proximal auger end-region is positioned generally adjacent said at least one power coupler;

c) said at least one distal auger end-region is positioned generally adjacent said at least one ball passage; and d) said at least one first guide-wall comprises at least one first guide ramp structured and arranged to guide the paintballs toward said at least one proximal auger end-region.

37. The paintball loader system according to claim 36 wherein:

a) said at least one second guide-wall comprises at least one second guide ramp structured and arranged to guide the paintballs toward said at least one distal auger end-region; and b) said at least one second guide-wall comprises at least one ejection ramp structured and arranged to lift paintballs unfavorably positioned for delivery to said at least one ball passage from said at least one conveyor as such paintballs approach said at least one transverse guide wall.

38. The paintball loader system according to claim 32 wherein:

a) said at least one rotatable auger is free to move axially along said at least one longitudinal axis of rotation between at least one first position and at least one second position;

b) said at least one power coupler comprises at least one rotation adjuster structured and arranged to adjust the rotation of said at least one rotatable auger by said at least one mechanical power source when said at least one rotatable auger is in said at least one second position;

c) said at least one power coupler comprises at least one positional biaser structured and arranged to bias said at least one rotatable auger toward said at least one first position;

d) said at least one rotatable auger is translated to said at least one second position by at least one pressure resistance exerted between the paintballs within said at least one ball channel.

39. The paintball loader system according to claim 38 further comprising:

a) at least one removable tray assembly structured and arranged to be removable from said at least one paintball storage compartment;

b) wherein said at least one removable tray assembly at least comprises said at least one rotatable auger, said at least one mechanical power source, and said at least one power coupler.

40. A paintball loader system comprising:

a) at least one paintball storage compartment to store paintballs;

b) at least one ball passage structured and arranged to pass the paintballs between said at least one paintball storage compartment and at least one paintball gun;

c) rotatably mounted within said at least one paintball storage compartment, at least one rotatable auger to convey the paintballs from said at least one paintball storage compartment to said at least one ball passage;

d) at least one rotator structured and arranged to rotate said at least one rotatable auger;

e) at least one rotation controller structured and arranged to control the rotation of said at least one rotatable auger; and f) operationally coupled with said at least one rotation controller, at least one load sensor structured and arranged to sense force loading on said at least one rotatable auger;

g) wherein rotation of said at least one rotatable auger exerts at least one force on at least one paintball during such rotation;

h) wherein such at least one force conveys the at least one paintball generally toward said at least one ball passage;

i) wherein said at least one rotatable auger comprises at least one resilient material structured and arranged to resiliently engage the at least one paintball during such conveyance;

j) wherein said at least one resilient material is further structured and arranged to assist in maintaining such at least one moving force within a limit settable by at least one selected resiliency;

k) wherein said at least one rotational controller is structured and arranged to adjust the rotation of said at least one rotatable auger in response to such force loading; and l) wherein such adjustment to the rotation assists in maintaining such at least one force within such limit.

* * * * *